US011835897B2

(12) United States Patent
Furuichi

(10) Patent No.: US 11,835,897 B2
(45) Date of Patent: Dec. 5, 2023

(54) ROTATOR DRIVER, HEATING DEVICE, FIXING DEVICE, AND IMAGE FORMING APPARATUS

(71) Applicant: Yuusuke Furuichi, Kanagawa (JP)

(72) Inventor: Yuusuke Furuichi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/950,102

(22) Filed: Sep. 22, 2022

(65) Prior Publication Data

US 2023/0110956 A1 Apr. 13, 2023

(30) Foreign Application Priority Data

Oct. 11, 2021 (JP) ..... 2021-166832

(51) Int. Cl.
*G03G 15/20* (2006.01)
*G03G 15/00* (2006.01)

(52) U.S. Cl.
CPC ..... *G03G 15/2053* (2013.01); *G03G 15/2064* (2013.01); *G03G 15/757* (2013.01); *G03G 2215/2038* (2013.01)

(58) Field of Classification Search
None
See application file for complete search history.

(56) References Cited

U.S. PATENT DOCUMENTS 5,675,893 A 10/1997 Yamada et al.
5,907,750 A * 5/1999 Yamada ..... G03G 15/0935 399/119
2006/0182474 A1 8/2006 Naito et al.
2016/0179043 A1* 6/2016 Kawaguchi ..... G03G 15/2053 399/329

(Continued)

FOREIGN PATENT DOCUMENTS

JP 2006-259039 A 9/2006
JP 2011-002710 1/2011

(Continued)

OTHER PUBLICATIONS

Extended European Search Report dated Feb. 23, 2023 in European Patent Application No. 22195270.8, 8 pages.

(Continued)

*Primary Examiner* — Sevan A Aydin
(74) *Attorney, Agent, or Firm* — XSENSUS LLP

(57) ABSTRACT

A rotator driver includes an endless rotator having an end face in a longitudinal direction thereof. A slide aid contacts an inner circumferential face of the endless rotator. A lubricant is applied between the slide aid and the inner circumferential face of the endless rotator. An end face contact member contacts the end face of the endless rotator and has an end face opposed face contacting the end face of the endless rotator and an opposite face being opposite to the end face opposed face. A helical gear is mounted on the opposite face of the end face contact member. The helical gear has teeth being oriented to generate a force that moves (Continued)

the end face contact member toward the end face of the endless rotator as the helical gear rotates. The helical gear has an outer diameter being not greater than an outer diameter of the endless rotator.

19 Claims, 22 Drawing Sheets

(56) References Cited

U.S. PATENT DOCUMENTS

| | | | | |
|---|---|---|---|---|
| 2017/0090354 | A1* | 3/2017 | Furuyama ..... | G03G 15/6585 |
| 2022/0179338 | A1 | 6/2022 | Seshita et al. | |
| 2022/0283530 | A1 | 9/2022 | Adachi et al. | |

FOREIGN PATENT DOCUMENTS

| | | |
|---|---|---|
| JP | 2016-118621 | 6/2016 |
| JP | 2019-144411 | 8/2019 |
| JP | 2019-148618 | 9/2019 |
| JP | 2020-076910 | 5/2020 |

OTHER PUBLICATIONS

U.S. Appl. No. 17/694,719, filed Mar. 15, 2022, Yukimichi Someya, et al.
U.S. Appl. No. 17/582,371, filed Jan. 24, 2022, Takayuki Seki, et al.
U.S. Appl. No. 17/692,177, filed Mar. 11, 2022, Hiroyuki Shimada, et al.

* cited by examiner

ROTATOR DRIVER, HEATING DEVICE, FIXING DEVICE, AND IMAGE FORMING APPARATUS

CROSS-REFERENCE TO RELATED APPLICATION

This patent application is based on and claims priority pursuant to 35 U.S.C. § 119(a) to Japanese Patent Application No. 2021-166832, filed on Oct. 11, 2021, in the Japan Patent Office, the entire disclosure of which is hereby incorporated by reference herein.

BACKGROUND

Technical Field

Embodiments of this disclosure relate to a rotator driver, a heating device, a fixing device, and an image forming apparatus.

Related Art

Related-art image forming apparatuses, such as copiers, facsimile machines, printers, and multifunction peripherals (MFP) having two or more of copying, printing, scanning, facsimile, plotter, and other functions, typically form an image on a recording medium according to image data.

Such image forming apparatuses include a fixing device, that includes an endless belt, as one example of a rotator driver.

In the fixing device incorporating the endless belt that is rotatable, when the endless belt interrupts rotation while a heater heats the endless belt, the heater may heat an identical portion on the endless belt continuously, overheating the endless belt.

SUMMARY

This specification describes below an improved rotator driver. In one embodiment, the rotator driver is rotated mainly in one direction and includes an endless rotator that rotates and has an end face in a longitudinal direction thereof. A slide aid contacts an inner circumferential face of the endless rotator. A lubricant is applied between the slide aid and the inner circumferential face of the endless rotator. An end face contact member has an end face opposed face contacting the end face of the endless rotator and an opposite face being opposite to the end face opposed face. A helical gear is mounted on the opposite face of the end face contact member. The helical gear has teeth of which helix angle is oriented to generate a force that moves the end face contact member toward the end face of the endless rotator as the helical gear rotates in the one direction. The helical gear has an outer diameter being not greater than an outer diameter of the endless rotator.

This specification further describes an improved heating device. In one embodiment, the heating device includes an endless rotator that rotates mainly in one direction and has an end face in a longitudinal direction thereof. A slide aid contacts an inner circumferential face of the endless rotator. A lubricant is applied between the slide aid and the inner circumferential face of the endless rotator. An end face contact member has an end face opposed face contacting the end face of the endless rotator and an opposite face being opposite to the end face opposed face. A helical gear is mounted on the opposite face of the end face contact member. The helical gear has teeth of which helix angle is oriented to generate a force that moves the end face contact member toward the end face of the endless rotator as the helical gear rotates in the one direction. The helical gear has an outer diameter being not greater than an outer diameter of the endless rotator. An opposed rotator contacts an outer circumferential face of the endless rotator to form a nip between the endless rotator and the opposed rotator.

This specification further describes an improved fixing device. In one embodiment, the fixing device includes the heating device described above.

This specification further describes an improved image forming apparatus. In one embodiment, the image forming apparatus includes an image bearer that bears an image and the fixing device described above that fixes the image on a recording medium.

BRIEF DESCRIPTION OF THE DRAWINGS

A more complete appreciation of embodiments of the present disclosure and many of the attendant advantages and features thereof can be readily obtained and understood from the following detailed description with reference to the accompanying drawings, wherein.

Figure 1:
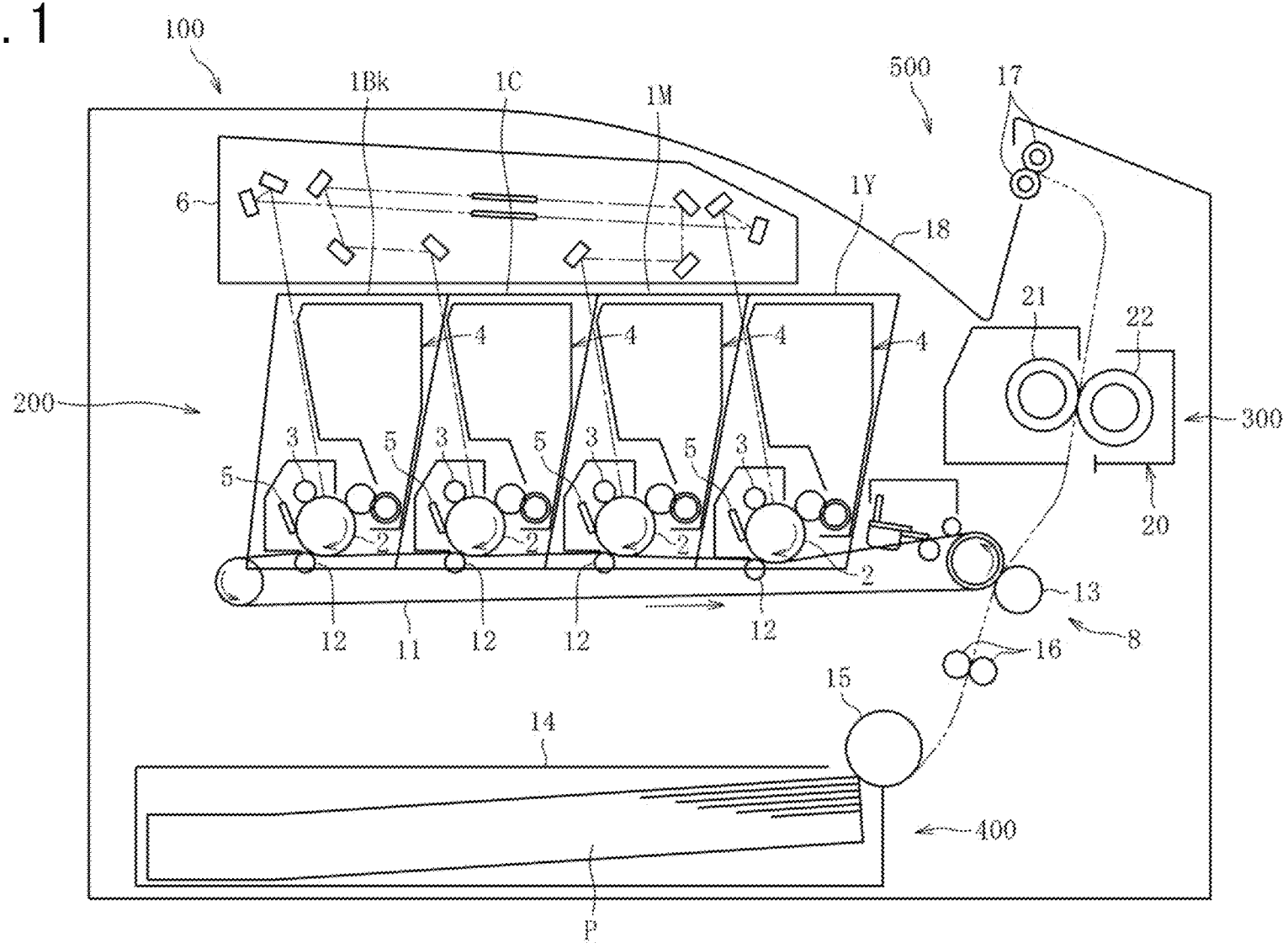
FIG. 1 is a schematic cross-sectional view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a," "an," and "the" are intended to include the plural forms as well, unless the context clearly indicates otherwise.

Referring to attached drawings, the following describes embodiments of the present disclosure. In the drawings for explaining the embodiments of the present disclosure, identical reference numerals are assigned to elements such as members and parts that have an identical function or an identical shape as long as differentiation is possible and a description of the elements is omitted once the description is provided.

FIG. 1 is a schematic cross-sectional view of an image forming apparatus 100 according to an embodiment of the present disclosure. The image forming apparatus 100 is a printer. Alternatively, the image forming apparatus 100 may be a copier, a facsimile machine, a multifunction peripheral (MFP) having at least two of printing, copying, facsimile, scanning, and plotter functions, or the like. Image formation described below denotes forming an image having meaning such as characters and figures and an image not having meaning such as patterns.

Referring to FIG. 1, a description is provided of an overall construction and operations of the image forming apparatus 100 according to an embodiment of the present disclosure.

As illustrated in FIG. 1, the image forming apparatus 100 according to the embodiment includes an image forming portion 200, a fixing portion 300, a recording medium supply portion 400, and a recording medium ejecting portion 500. The image forming portion 200 forms a toner image on a sheet P serving as a recording medium. The fixing portion 300 fixes the toner image on the sheet P. The recording medium supply portion 400 supplies the sheet P to the image forming portion 200. The recording medium ejecting portion 500 ejects the sheet P onto an outside of the image forming apparatus 100.

The image forming portion 200 includes four process units 1Y, 1M, 1C, and 1Bk, an exposure device 6, and a transfer device 8. The process units 1Y, 1M, 1C, and 1Bk serve as image forming units, respectively. The exposure device 6 forms an electrostatic latent image on a photoconductor 2 of each of the process units 1Y, 1M, 1C, and 1Bk. The transfer device 8 transfers the toner image onto the sheet P.

The process units 1Y, 1M, 1C, and 1Bk basically have similar constructions, respectively. However, the process units 1Y, 1M, 1C, and 1Bk contain toners, serving as developers, in different colors, that is, yellow, magenta, cyan, and black, respectively, which correspond to color separation components for a color image. For example, each of the process units 1Y, 1M, 1C, and 1Bk includes the photoconductor 2, a charger 3, a developing device 4, and a cleaner 5. The photoconductor 2 serves as an image bearer that bears an image (e.g., an electrostatic latent image and a toner image) on a surface of the photoconductor 2. The charger 3 charges the surface of the photoconductor 2. The developing device 4 supplies the toner as the developer to the surface of the photoconductor 2 to form a toner image. The cleaner 5 cleans the surface of the photoconductor 2.

The transfer device 8 includes an intermediate transfer belt 11, primary transfer rollers 12, and a secondary transfer roller 13. The intermediate transfer belt 11 is an endless belt that is stretched taut across a plurality of support rollers. The four primary transfer rollers 12 are disposed within a loop formed by the intermediate transfer belt 11. The primary transfer rollers 12 are pressed against the photoconductors 2, respectively, via the intermediate transfer belt 11, thus forming primary transfer nips between the intermediate transfer belt 11 and the photoconductors 2. The secondary transfer roller 13 contacts an outer circumferential surface of the intermediate transfer belt 11 to form a secondary transfer nip therebetween.

The fixing portion 30W includes a fixing device 20. The fixing device 20 includes a fixing belt 21 and a pressure roller 22. The fixing belt 21 is an endless belt. The pressure roller 22 serves as an opposed rotator that is disposed opposite the fixing belt 21. The pressure roller 22 has an outer circumferential face that contacts an outer circumferential face of the fixing belt 21 to form a nip (e.g., a fixing nip) therebetween.

The recording medium supply portion 400 includes a sheet tray 14 (e.g., a paper tray) and a feed roller 15. The sheet tray 14 loads a plurality of sheets P serving as recording media. The feed roller 15 picks up and feeds a sheet P from the sheet tray 14. According to the embodiments below, a sheet is used as a recording medium. However, the recording medium is not limited to paper as the sheet. In addition to paper as the sheet, the recording media include an overhead projector (OHP) transparency, cloth, a metal sheet, plastic film, and a prepreg sheet pre-impregnated with resin in carbon fibers. In addition to plain paper, the sheets include thick paper, a postcard, an envelope, thin paper, coated paper, art paper, and tracing paper.

The recording medium ejecting portion 500 includes an output roller pair 17 and an output tray 18. The output roller pair 17 ejects the sheet P onto the outside of the image forming apparatus 100. The output tray 18 is placed with the sheet P ejected by the output roller pair 17. The image forming apparatus 100 further includes a timing roller pair 16.

Referring to FIG. 1, a description is provided of printing processes performed by the image forming apparatus 100 according to the embodiment.

When the image forming apparatus 100 receives an instruction to start printing, a driver starts driving and rotating the photoconductor 2 of each of the process units 1Y, 1M, 1C, and 1Bk clockwise in FIG. 1 and the intermediate transfer belt 11 of the transfer device 8 counterclockwise in FIG. 1. The feed roller 15 starts rotation, feeding a sheet P from the sheet tray 14. As the sheet P fed by the feed roller 15 comes into contact with the timing roller pair 16, the timing roller pair 16 temporarily halts the sheet P. Thus, the timing roller pair 16 interrupts conveyance of the sheet P until the toner image is formed on the intermediate transfer belt 11.

The charger 3 of each of the process units 1Y, 1M, 1C, and 1Bk charges the surface of the photoconductor 2 evenly at a high electric potential. The exposure device 6 exposes the charged surfaces of the photoconductors 2, respectively, according to image data sent from a terminal. Alternatively, if the image forming apparatus 100 is a copier, the exposure device 6 exposes the charged surfaces of the photoconductors 2, respectively, according to image data created by a scanner that reads an image on an original. Accordingly, the electric potential of an exposed portion on the surface of each of the photoconductors 2 decreases, forming an electrostatic latent image on the surface of each of the photoconductors 2. The developing device 4 of each of the process units 1Y, 1M, 1C, and 1Bk supplies toner to the electrostatic latent image formed on the photoconductor 2, forming a toner image thereon. When the toner images formed on the photoconductors 2 reach the primary transfer nips defined by the primary transfer rollers 12 in accordance with rotation of the photoconductors 2, respectively, the primary transfer rollers 12 transfer the toner images formed on the photoconductors 2 onto the intermediate transfer belt 11 driven and rotated counterclockwise in FIG. 1 successively such that the toner images are superimposed on the intermediate transfer belt 11. Thus, the superimposed toner images form a full color toner image on the intermediate transfer belt 11. Alternatively, in the image forming apparatus 100, one of the four process units 1Y, 1M, 1C, and 1Bk may be used to form a monochrome toner image or two or three of the four process units 1Y, 1M, 1C, and 1Bk may be used to form a bicolor toner image or a tricolor toner image. After the toner image formed on the photoconductor 2 is transferred onto the intermediate transfer belt 11, the cleaner 5 removes residual toner and the like remaining on the photoconductor 2 therefrom.

The full color toner image formed on the intermediate transfer belt 11 is conveyed to the secondary transfer nip defined by the secondary transfer roller 13 in accordance with rotation of the intermediate transfer belt 11 and is transferred onto the sheet P conveyed by the timing roller pair 16. Thereafter, the sheet P transferred with the full color toner image is conveyed to the fixing device 20 where the fixing belt 21 and the pressure roller 22 fix the full color toner image on the sheet P under heat and pressure. The sheet P is conveyed to the recording medium ejecting portion 500 where the output roller pair 17 ejects the sheet P onto the output tray 18. Thus, a series of printing processes is finished.

Figure 2:
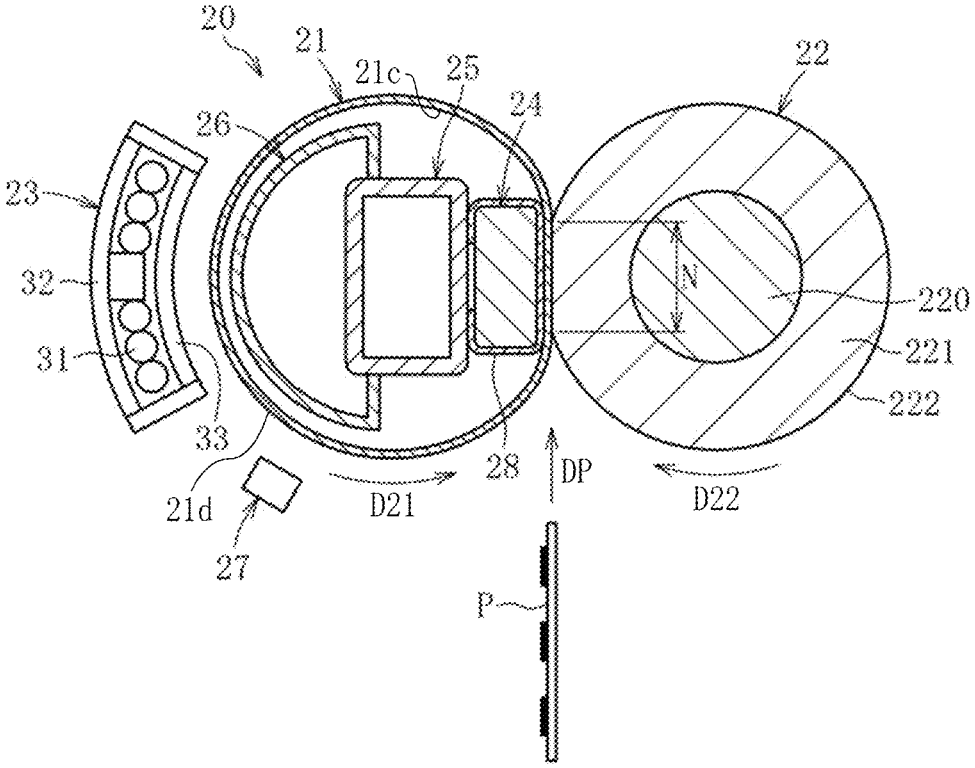
FIG. 2 is a schematic cross-sectional view of a fixing device according to an embodiment of the present disclosure that is incorporated in the image forming apparatus depicted in FIG. 1.

Referring to FIG. 2, a detailed description is provided of a construction of the fixing device 20 according to an embodiment of the present disclosure.

As illustrated in FIG. 2, in addition to the fixing belt 21 and the pressure roller 22, the fixing device 20 according to the embodiment includes an electromagnetic induction heater 23, a nip formation pad 24, a stay 25, a guide 26, and a temperature sensor 27.

The fixing belt 21 contacts an unfixed toner image bearing side of a sheet P, which bears an unfixed toner image. The fixing belt 21 serves as a rotator, an endless rotator, or a fixing rotator that fixes the unfixed toner image (e.g., unfixed toner) on the sheet P. The fixing belt 21 rotates in a rotation direction D21. The fixing belt 21 is an endless belt that has flexibility. The fixing belt 21 has a diameter in a range of from 15 mm to 120 mm, for example. According to the embodiment, the fixing belt 21 has an inner diameter of 25 mm.

For example, the fixing belt 21 includes a base layer serving as an inner circumferential surface layer of the fixing belt 21, an elastic layer disposed on the base layer, and a release layer disposed on the elastic layer. The fixing belt 21 has a total thickness of 1 mm or smaller. The base layer of the fixing belt 21 has a layer thickness in a range of from 30 μm to 50 μm and is made of a metal material such as nickel and stainless steel or a resin material such as polyimide. The elastic layer of the fixing belt 21 has a layer thickness in a range of from 100 μm to 300 μm and is made of a rubber material such as silicone rubber, silicone rubber foam, and fluororubber. Since the fixing belt 21 incorporates the elastic layer, the elastic layer prevents slight surface asperities from being produced on a surface of the fixing belt 21 at a fixing nip N formed between the fixing belt 21 and the pressure roller 22. Accordingly, heat is quickly conducted from the fixing belt 21 to the toner image on the sheet P evenly. The release layer of the fixing belt 21 has a layer thickness in a range of from 10 μm to 50 μm. The release layer of the fixing belt 21 is made of perfluoroalkoxy alkane (PFA), polytetrafluoroethylene (PTFE), polyimide, polyether imide, polyether sulfone (PES), or the like. As the fixing belt 21 incorporates the release layer, the release layer facilitates separation and peeling of toner of the toner image formed on the sheet P from the fixing belt 21.

Figure 3:
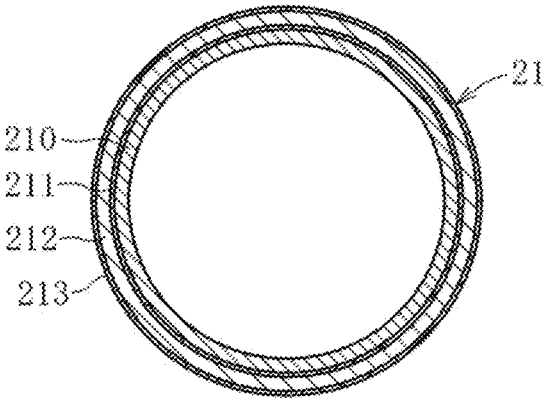
FIG. 3 is a cross-sectional view of a fixing belt incorporated in the fixing device depicted in FIG. 2.

In addition to the base layer, the elastic layer, and the release layer, the fixing belt 21 includes a heat generating layer that generates heat by electromagnetic induction heating by the electromagnetic induction heater 23. For example, as illustrated in FIG. 3, the fixing belt 21 includes a base layer 210 serving as the inner circumferential surface layer of the fixing belt 21, a heat generating layer 211 disposed on the base layer 210, an elastic layer 212 disposed on the heat generating layer 211, and a release layer 213 disposed on the elastic layer 212 and serving as an outer circumferential surface layer of the fixing belt 21. Alternatively, the heat generating layer 211 may be interposed between the elastic layer 212 and the release layer 213. The base layer 210 may serve as a heat generating layer. The heat generating layer 211 is made of nickel, stainless steel, iron, copper, cobalt, chromium, aluminum, gold, platinum, silver, tin, palladium, an alloy made of a plurality of metals described above, or the like.

As illustrated in FIG. 2, the pressure roller 22 serves as an opposed rotator disposed opposite the fixing belt 21. The pressure roller 22 has an outer diameter of 25 mm, for example. The pressure roller 22 contacts the outer circumferential face of the fixing belt 21 to form the fixing nip N between the fixing belt 21 and the pressure roller 22. The pressure roller 22 rotates in a rotation direction D22.

For example, the pressure roller 22 includes a core metal 220 that is solid and made of iron, an elastic layer 221 that is disposed on an outer circumferential surface of the core metal 220, and a release layer 222 that is disposed on an outer circumferential surface of the elastic layer 221. The elastic layer 221 has a thickness of 3.5 mm, for example, and is made of silicone rubber or the like. The release layer 222 has a thickness of approximately 40 μm, for example, and is made of fluororesin or the like.

The electromagnetic induction heater 23 serves as a heater that includes an exciting coil 31, a core 32, and a coil guide 33. The exciting coil 31 includes litz wire that is made of bundled thin wires and covers apart of the fixing belt 21. The litz wire extends in a longitudinal direction of the fixing belt 21. The longitudinal direction of the fixing belt 21 denotes a direction perpendicular to a paper surface in FIG. 2 and is parallel to a width direction of the sheet P conveyed through the fixing nip N (e.g., a direction perpendicular to a sheet conveyance direction DP of the sheet P) or an axial direction of the pressure roller 22. A longitudinal direction of a fixing belt described below is also defined as described above. The coil guide 33 is made of a resin material or the like having an enhanced heat resistance and holds the exciting coil 31 and the core 32. The core 32 is semi-tubular and made of a ferromagnet, such as ferrite, which has a relative permeability approximately in a range of from 1000 to 3,000. In order to create a magnetic flux directed to the fixing belt 21 effectively, the core 32 includes a center core and side cores. The core 32 is disposed opposite the exciting coil 31.

The nip formation pad 24 contacts an inner circumferential face 21*c* of the fixing belt 21. The pressure roller 22 presses against the nip formation pad 24 via the fixing belt 21 to form the fixing nip N between the fixing belt 21 and the pressure roller 22. The nip formation pad 24 is made of a heat-resistant material that has heat resistance of 200 degrees Celsius and enhanced mechanical strength. The nip formation pad 24 is preferably made of a heat-resistant resin material such as polyimide and polyether ether ketone (PEEK). The nip formation pad 24 may be made of a metal material. As the nip formation pad 24 is made of the above-described material that has an enhanced mechanical strength and an enhanced heat resistance, the nip formation pad 24 is immune from thermal deformation in a toner fixing temperature range in which the toner image is fixed on the sheet P, stabilizing the fixing nip N and quality of the toner image output on the sheet P.

The nip formation pad 24 mounts a slide sheet 28 on a fixing nip opposed face of the nip formation pad 24, which is disposed opposite the fixing nip N. For example, the slide sheet 28 is produced with yarn made of PTFE and impregnated with a lubricant such as silicone oil. The nip formation pad 24 presses against the inner circumferential face 21*c* of the fixing belt 21 via the slide sheet 28. Hence, while the fixing belt 21, that rotates, slides over the nip formation pad 24 via the slide sheet 28, the slide sheet 28 decreases sliding friction, suppressing abrasion of the fixing belt 21. Alternatively, the slide sheet 28 may be removed and the nip formation pad 24 may contact the inner circumferential face 21*c* of the fixing belt 21 directly.

The stay 25 serves as a support that supports the nip formation pad 24. The stay 25 supports an opposite face that is opposite to the fixing nip opposed face of the nip formation pad 24, throughout an entire span of the nip formation pad 24 in the longitudinal direction of the fixing belt 21. Accordingly, the stay 25 prevents the nip formation pad 24 from being bent by pressure from the pressure roller 22, forming the fixing nip N between the fixing belt 21 and the pressure roller 22 such that the fixing nip N has an even length in the sheet conveyance direction DP throughout the entire span of the nip formation pad 24. The stay 25 is preferably made of a ferrous metal material such as stainless used steel (SUS) and steel electrolytic cold commercial (SECC) to achieve rigidity.

The guide 26 is disposed within a loop formed by the fixing belt 21 and guides the fixing belt 21 so that the fixing belt 21 rotates stably. The guide 26 has an arc shape in cross section that is curved along the inner circumferential face 21*c* of the fixing belt 21. The guide 26 is secured to the stay 25.

The temperature sensor 27 serves as a temperature detector that detects a temperature of the fixing belt 21. The fixing device 20 according to the embodiment employs, as the temperature detector, the temperature sensor 27, that is, a non-contact type temperature sensor, which does not contact an outer circumferential face 21*d* of the fixing belt 21 and detects an ambient temperature at a position in proximity to the outer circumferential face 21*d* of the fixing belt 21. Alternatively, the temperature detector may be a contact type temperature sensor that contacts the surface of the fixing belt 21 and detects a temperature of the surface of the fixing belt 21.

A description is provided of operations of the fixing device 20 having the construction described above.

While the fixing belt 21 and the pressure roller 22 rotate in the rotation directions D21 and D22, respectively, the electromagnetic induction heater 23 heats the fixing belt 21 disposed opposite the electromagnetic induction heater 23. Specifically, as an alternating current with a high frequency flows through the exciting coil 31, magnetic lines of force generate around the fixing belt 21 and alternate bidirectionally. An eddy current generates on a surface of the heat generating layer 211. An electric resistance of the heat generating layer 211 generates Joule heat. The Joule heat heats the heat generating layer 211 by electromagnetic induction heating, thus heating the fixing belt 21.

The temperature sensor 27 detects the temperature of the fixing belt 21. The fixing device 20 further includes a controller that controls the electromagnetic induction heater 23 based on the temperature of the fixing belt 21, which is detected by the temperature sensor 27. The controller retains a predetermined temperature (e.g., a fixing temperature) of the fixing belt 21. While the fixing belt 21 retains the predetermined temperature, as illustrated in FIG. 2, as a sheet P bearing an unfixed toner image (e.g., unfixed toner) enters the fixing nip N formed between the fixing belt 21 and the pressure roller 22, the fixing belt 21 and the pressure roller 22 that rotate in the rotation directions D21 and D22, respectively, convey the sheet P. While the sheet P passes through the fixing nip N, the fixing belt 21 and the pressure roller 22 fix the unfixed toner image on the sheet P under heat and pressure.

Figure 4:
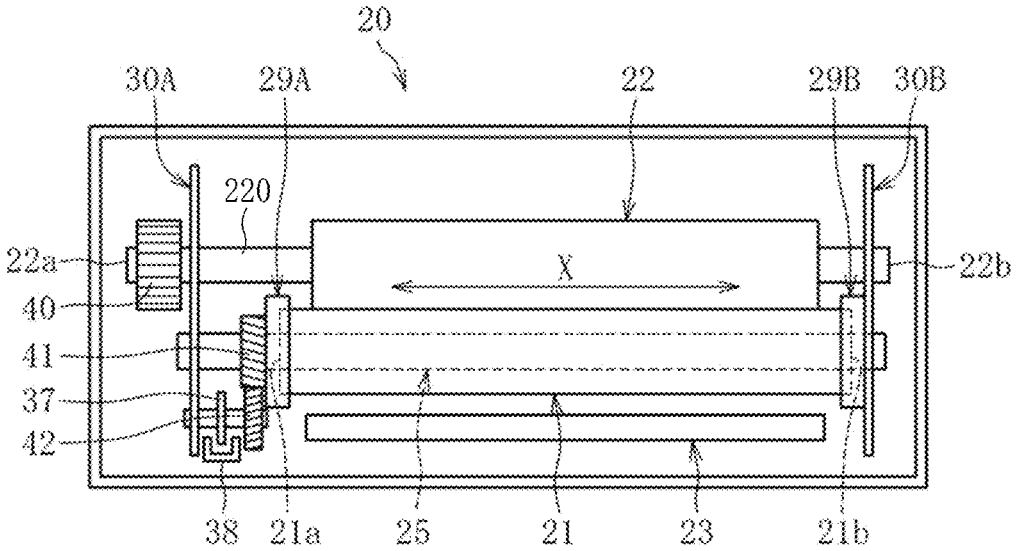
FIG. 4 is a diagram of a support structure and a driver of the fixing belt and a pressure roller incorporated in the fixing device depicted in FIG. 2.
Figure 5:
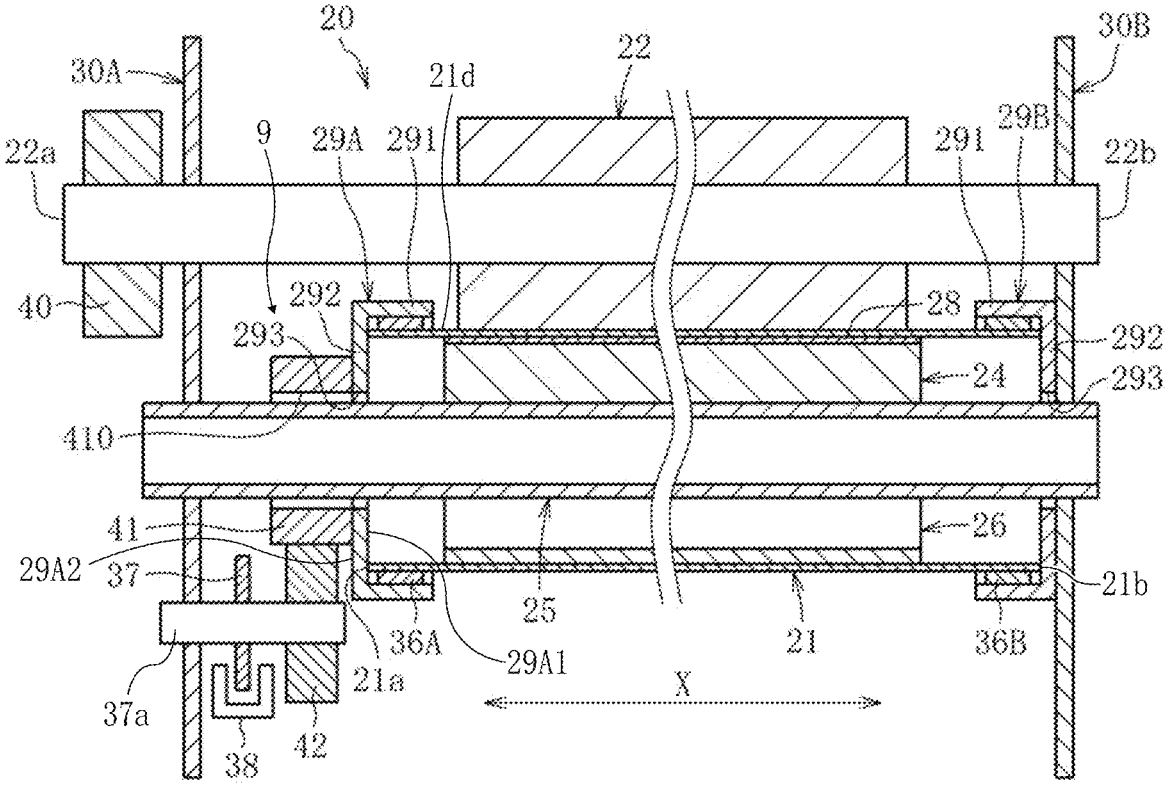
FIG. 5 is a diagram of the fixing device depicted in FIG. 2.

Referring to FIGS. 4 and 5, a description is provided of a construction of each of the support structure and the driver of the pressure roller 22 and the fixing belt 21 according to an embodiment of the present disclosure.

As illustrated in FIGS. 4 and 5, the fixing device 20 further includes a rotator driver 9 that includes the fixing belt 21, the nip formation pad 24, the slide sheet 28, elastic layers 36A and 36B, caps 29A and 29B, a first gear 41, a second gear 42, a rotary member 37, and a photo interrupter 38. The fixing device 20 further includes a pair of side plates 30A and 308 serving as a frame that supports the fixing belt 21 and the pressure roller 22 such that the fixing belt 21 and the pressure roller 22 rotate. For example, the pressure roller 22 includes a rotation shaft (e.g., the core metal 220) that has both lateral ends 22*a* and 22*b* in the axial direction of the pressure roller 22, which are attached to and supported by the side plates 30A and 30B, respectively, such that the rotation shaft rotates. As illustrated in FIG. 5, the stay 25 is attached to the side plates 30A and 30B. The guide 26 and the nip formation pad 24 are supported by the stay 25. The stay 25, the guide 26, and the nip formation pad 24 support the fixing belt 21 such that the fixing belt 21 rotates.

As illustrated in FIG. 4, one lateral end 22*a* (e.g., a left end in FIG. 4) of the rotation shaft (e.g., the core metal 220) of the pressure roller 22 in the axial direction thereof mounts the driving force transmitting gear 40 that receives a driving force transmitted from the driver disposed inside a body of the image forming apparatus 100. When the fixing device 20 is installed in the body of the image forming apparatus 100, the driving force transmitting gear 40 is coupled to a driving gear disposed inside the body of the image forming apparatus 100 so that the driving force transmitting gear 40 is ready to receive the driving force transmitted from the driver. As the driving force is transmitted to the driving force transmitting gear 40 from the driver disposed inside the body of the image forming apparatus 100, the driving force drives and rotates the pressure roller 22. As the driver drives and rotates the pressure roller 22, the fixing belt 21 is driven and rotated by the pressure roller 22.

Figure 6:
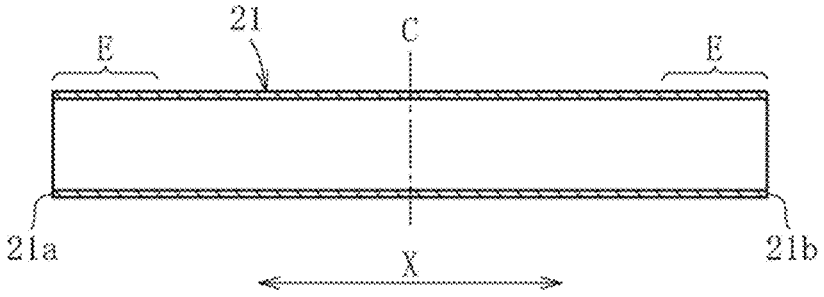
FIG. 6 is a cross-sectional view of the fixing belt depicted in FIG. 3, illustrating lateral ends and end faces of the fixing belt in a longitudinal direction thereof.

As illustrated in FIG. 4, the fixing belt 21 includes both end faces 21*a* and 21*b* in a longitudinal direction X of the fixing belt 21, which mount a pair of caps 29A and 29B serving as end face contact members that contact the end faces 21*a* and 21*b*, respectively. As illustrated in FIG. 5, each of the caps 29A and 29B includes a peripheral wall 291 and an end wall 292. The peripheral wall 291 is tubular. The end wall 292 abuts on one end of the peripheral wall 291 in an axial direction thereof. The end wall 292 of each of the caps 29A and 29B has a hole 293 through which the stay 25 is inserted. In a state in which the caps 29A and 29B are attached to both lateral ends of the fixing belt 21 in the longitudinal direction X thereof, respectively, an inner circumferential face of the peripheral wall 291 of each of the caps 29A and 29B is disposed opposite the outer circumferential face 21*d* of the fixing belt 21 at both lateral ends of the fixing belt 21 in the longitudinal direction X thereof. The end walls 292 of the caps 29A and 29B contact the end faces 21*a* and 21*b* of the fixing belt 21 (hereinafter referred to as both end faces of the fixing belt) in the longitudinal direction X thereof, respectively. As illustrated in FIG. 6, both lateral ends of the fixing belt 21 in the longitudinal direction X thereof denote both lateral end regions E, respectively, that are disposed outboard from a center region including a center C in the longitudinal direction X of the fixing belt 21. The center region including the center C has a length in the longitudinal direction X of the fixing belt 21, which is not smaller than one third of an entire length of the fixing belt 21 in the longitudinal direction X thereof and is smaller than the entire length of the fixing belt 21. The end faces of the fixing belt 21 denote lateral edges of the fixing belt 21 in the longitudinal direction X thereof, that is, the end faces 21*a* and 21*b*, respectively, that are perpendicular to the longitudinal direction X of the fixing belt 21.

As illustrated in FIG. 5, the fixing device 20 further includes the elastic layers 36A and 36B that are interposed between the inner circumferential faces of the peripheral walls 291 and the outer circumferential face 21*d* of the fixing belt 21 in both lateral ends of the fixing belt 21 in the longitudinal direction X thereof, respectively. Each of the elastic layers 36A and 36B is annular and made of a material having an increased coefficient of friction such as silicone rubber. Each of the elastic layers 36A and 36B is interposed between the inner circumferential face of the peripheral wall 291 and the outer circumferential face 21*d* of the fixing belt 21. Each of the elastic layers 36A and 36B contacts the peripheral wall 291 and the outer circumferential face 21*d* of the fixing belt 21. Accordingly, as the fixing belt 21 rotates, torque of the fixing belt 21 is transmitted to the caps 29A and 29B through the elastic layers 36A and 36B, respectively. Consequently, the caps 29A and 29B rotate in accordance with rotation of the fixing belt 21.

As illustrated in FIG. 5, one of the pair of caps 29A and 29B, that is, the cap 29A as a left cap in FIG. 4, mounts the first gear 41 that transmits torque to the rotary member 37 described below. The cap 29A, that is, one of the pair of caps 29A and 29B, has an end face opposed face 29A1 that contacts the end face 21*a* of the fixing belt 21 and an opposite face 29A2 (e.g., a left face in FIG. 5) that is opposite to the end face opposed face 29A1. The first gear 41 is secured to the opposite face 29A2. Hence, as the cap 29A rotates, the first gear 41 rotates in accordance with rotation of the cap 29A. As illustrated in FIG. 5, like the cap 29A, the first gear 41 has a hole 410 through which the stay 25 is inserted.

The rotary member 37 is a disk. The rotary member 37 is supported by one of the side plates 30A and 30B, that is, the side plate 30A (e.g., a left side plate in FIG. 4) such that the rotary member 37 rotates. As illustrated in FIG. 5, the rotary member 37 includes a rotation shaft 37*a* that has one lateral end supported by the side plate 30A and another lateral end that is opposite to the one lateral end and supports the second gear 42. The second gear 42 meshes with the first gear 41. The second gear 42 is secured to the rotation shaft 37*a* of the rotary member 37. Hence, as the second gear 42 rotates, the rotary member 37 rotates in accordance with rotation of the second gear 42.

The fixing device 20 according to the embodiment further includes the photo interrupter 38 serving as a rotation detector that detects rotation of the rotary member 37. The photo interrupter 38 includes a light emitter and a light receiver that sandwich the rotary member 37. The rotary member 37 includes a plurality of slits arranged in a rotation direction of the rotary member 37. As the rotary member 37 rotates, a light beam (e.g., infrared light) emitted from the light emitter passes through the slits and is received by the light receiver. The photo interrupter 38 counts a number of light beams that pass through the slits, detecting rotation (e.g., a number of rotations per unit time or an angle of rotation) of the rotary member 37. The rotation detector is not limited to an optical sensor including a light emitter and a light receiver and may be a magnetic sensor.

As described above, according to the embodiment, the photo interrupter 38 detects rotation of the rotary member 37, thus detecting whether or not the fixing belt 21 rotates and a number of rotations of the fixing belt 21. Specifically, as the pressure roller 22 rotates, the pressure roller 22 drives and rotates the fixing belt 21. The first gear 41 rotates in accordance with rotation of the fixing belt 21. The second gear 42 rotates in accordance with rotation of the first gear 41. The rotary member 37 rotates in accordance with rotation of the second gear 42. According to the embodiment, as the fixing belt 21 rotates, the rotary member 37 rotates in accordance with rotation of the fixing belt 21. The photo interrupter 38 detects rotation of the rotary member 37, thus detecting rotation of the fixing belt 21. Accordingly, even if the fixing belt 21 interrupts rotation while the electromagnetic induction heater 23 heats the fixing belt 21, the photo interrupter 38 detects interruption of rotation of the fixing belt 21, preventing overheating of the fixing belt 21.

A description is provided of a construction of a comparative fixing device.

The comparative fixing device includes an end face contact member (e.g., a cap) that contacts an end face of a belt. The comparative fixing device further includes a detecting construction that detects rotation of the end face contact member that rotates together with the belt. The detecting construction detects rotation of the end face contact member that rotates together with the belt, thus determining whether or not the belt rotates properly. In order to prevent the end face contact member (e.g., the cap) from slipping over the belt while the end face contact member rotates, an elastic layer having an increased coefficient of friction is interposed between the belt and the end face contact member.

In the comparative fixing device incorporating the belt, as the belt rotates, the belt slides over a slide aid such as a nip formation pad that contacts an inner circumferential face of the belt. In order to reduce sliding friction that generates as the belt rotates, a lubricant such as grease and oil is generally applied between the belt and the slide aid. However, rotation or the like of the belt may move the lubricant to a lateral end of the belt in a longitudinal direction thereof and the lubricant may enter a gap between the belt and the end face contact member. Accordingly, the lubricant may adhere to the elastic layer. If the lubricant adheres to the elastic layer, friction between the elastic layer and the belt or friction between the elastic layer and the end face contact member may decrease. Accordingly, the elastic layer may slip over the belt and the end face contact member may not rotate in accordance with rotation of the belt. To address this circumstance, the comparative fixing device includes a groove that is disposed in the end face contact member and holds the lubricant.

The groove disposed in the end face contact member stores the lubricant leaked from the inner circumferential face of the belt. However, if the lubricant leaks out from the groove due to rotation, vibration, or the like of the belt, the leaked lubricant may enter the gap between the belt and the end face contact member. Accordingly, the elastic layer may slip over the belt and the end face contact member may not rotate together with the belt. The comparative fixing device does not provide a solution to overcome a disadvantage of leakage of the lubricant from the inner circumferential face to an outer circumferential face of the belt.

As a pressure roller, that rotates, drives and rotates a fixing belt, the fixing belt slides over a slide aid such as a nip formation pad and a slide sheet disposed within a loop formed by the fixing belt. Since sliding friction generates between the fixing belt and the slide aid, a lubricant such as grease and oil is generally applied between the fixing belt and the slide aid. Also in the fixing device 20 according to the embodiment depicted in FIG. 2, the lubricant is applied between the fixing belt 21 and the slide sheet 28.

However, rotation or the like of the fixing belt 21 may move the lubricant to both lateral ends of the fixing belt 21 in the longitudinal direction X thereof. Accordingly, the lubricant may enter a gap between the end face 21*a* of the fixing belt 21 and the cap 29A and a gap between the end face 21*b* of the fixing belt 21 and the cap 29B depicted in FIG. 5. The lubricant may farther move onto the outer circumferential face 21*d* of the fixing belt 21 through the end faces 21*a* and 21*b* thereof, adhering to the elastic layers 36A and 36B, respectively. If the lubricant adheres to the elastic layers 36A and 36B, friction between the fixing belt 21 and each of the elastic layers 36A and 368 or friction between the elastic layers 36A and 36B and the caps 29A and 29B, respectively, may decrease. Accordingly, the elastic layers 36A and 36B may slip over the fixing belt 21 and the caps 29A and 29B may not rotate together with the fixing belt 21. Consequently, the photo interrupter 38 may not detect rotation of the fixing belt 21 precisely. Hence, if the fixing belt 21 interrupts rotation while the electromagnetic induction heater 23 heats the fixing belt 21, the fixing belt 21 may overheat.

As a solution to prevent the lubricant from entering a gap between the fixing belt 21 and each of the elastic layers 36A and 36B, a gap between the elastic layer 36A and the cap 29A, and a gap between the elastic layer 36B and the cap 29B, respectively, the fixing belt 21 contacts each of the elastic layers 36A and 36B and the elastic layers 36A and 36B contact the caps 29A and 29B, respectively, to prevent generation of the gaps throughout an entire span of the fixing belt 21 in the rotation direction D21 thereof. However, if the fixing belt 21 contacts each of the elastic layers 36A and 36B and the elastic layers 36A and 36B contact the caps 29A and 29B, respectively, throughout the entire span of the fixing belt 21 in the rotation direction D21 thereof, the elastic layers 36A and 36B and the caps 29A and 29B may not be attached to both lateral ends of the fixing belt 21 in the longitudinal direction X thereof easily. For example, if the fixing belt 21 has an increased diameter due to dimensional error caused in manufacturing, the elastic layers 36A and 36B and the caps 29A and 29B may not be attached to the fixing belt 21 easily. Even if the elastic layers 36A and 36B and the caps 29A and 29B are attached to the fixing belt 21, when the fixing device 20 operates and has an increased temperature, the elastic layers 36A and 36B and the caps 29A and 29B may expand thermally. Accordingly, an increased load may be imposed on the fixing belt 21, damaging the fixing belt 21. Hence, the solution in which the fixing belt 21 contacts each of the elastic layers 36A and 36B and the elastic layers 36A and 36B contact the caps 29A and 29B, respectively, throughout the entire span of the fixing belt 21 in the rotation direction D21 thereof may not prevent the lubricant from entering the gaps effectively.

As another solution, the elastic layers 36A and 36B may be elongated in the longitudinal direction X of the fixing belt 21. With this solution, even if the lubricant adheres to an end of each of the elastic layers 36A and 36B, the elastic layers 36A and 36B achieve friction in an outboard portion disposed outboard from the end adhered with the lubricant, thus being immune from slippage. However, if the elastic layers 36A and 368 are elongated, the elastic layers 36A and 36B may upsize the fixing device 20, hindering downsizing of the fixing device 20. Additionally, the lubricant adhered to the end of each of the elastic layers 36A and 36B may spread gradually, resulting in decreased friction of the elastic layers 36A and 36B. Hence, the elastic layers 36A and 36B may not retain friction over a lengthy period of time.

Further, if the elastic layers 36A and 36B deteriorate thermally, the elastic layers 36A and 36B may suffer from fissure. If a fissure appears on each of the elastic layers 36A and 36B and the lubricant enters the fissure by capillary action, the lubricant may adhere to the elastic layers 36A and 36B. For example, when sheets P having a small size are conveyed over the fixing belt 21, the sheets P do not draw heat from both lateral ends of the fixing belt 21 in the longitudinal direction X thereof, which are attached with the elastic layers 36A and 36B, respectively. Hence, both lateral ends of the fixing belt 21 in the longitudinal direction X thereof are susceptible to temperature increase or overheating that may produce fissure in the elastic layers 36A and 36B.

To address the circumstances described above, the fixing device 20 according to the embodiment has a configuration described below to prevent the lubricant from adhering to the elastic layers 36A and 36B. The following describes the configuration and operations of the fixing device 20 according to the embodiment, which prevent the lubricant from adhering to the elastic layers 36A and 36B.

Figure 7:
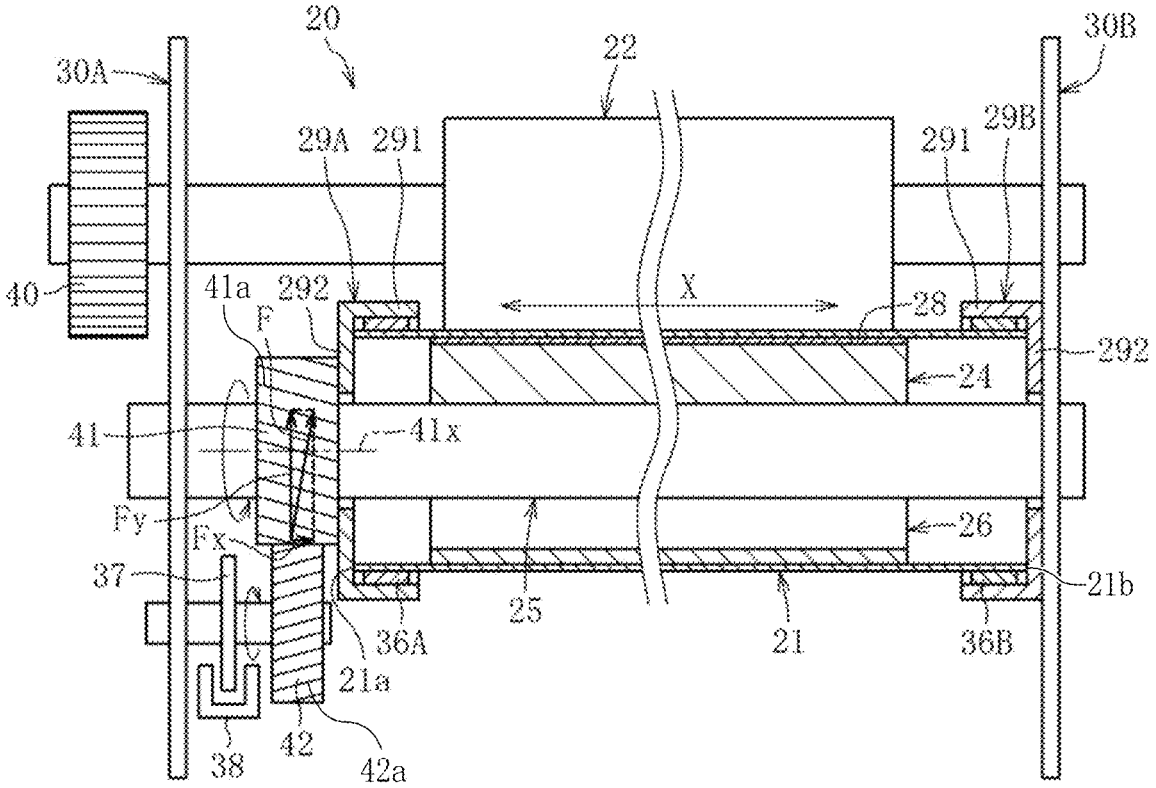
FIG. 7 is a diagram of the fixing device depicted in FIG. 5, illustrating a construction and operations thereof.

FIG. 7 is a cross-sectional view of the fixing device 20 according to an embodiment of the present disclosure, illustrating the configuration and the operations of the fixing device 20.

As illustrated in FIG. 7, the fixing device 20 according to the embodiment includes the first gear 41 that is mounted on the cap 29A and the second gear 42 that meshes with the first gear 41. Each of the first gear 41 and the second gear 42 is a helical gear. Unlike a spur gear, the helical gear includes a plurality of teeth that is mounted on an outer circumferential face of the helical gear and is slanted to an axis of rotation of the helical gear spirally.

As illustrated in FIG. 7, the first gear 41 and the second gear 42 include teeth 41*a* and 42*a*, respectively. At a meshing portion where the first gear 41 meshes with the second gear 42, as torque is transmitted from the first gear 41 to the second gear 42, when the teeth 41*a* of the first gear 41 press and move the teeth 42*a* of the second gear 42, a reactive force F generates on the first gear 41. The reactive force F generates in a direction perpendicular to a tooth trace direction (e.g., a direction in which the tooth 41*a* are angled) of the first gear 41. Hence, the reactive force F generates in a direction inclined with respect to a rotation shaft 41*x* of the first gear 41.

The reactive force F is decomposed into a perpendicular component Fy that is perpendicular to the rotation shaft 41*x* and a thrust force Fx, that is, a parallel component parallel to the rotation shaft 41*x*. The thrust force Fx (e.g., a thrust) as the parallel component parallel to the rotation shaft 41*x* is oriented rightward in FIG. 7. Hence, the first gear 41 receives the thrust force Fx and is biased rightward in FIG. 7 in a direction in which the first gear 41 moves closer to the end face 21*a* of the fixing belt 21. Accordingly, one of the caps 29A and 29B, that is, the cap 29A, is also biased rightward in FIG. 7. Consequently, the end wall 292 of the cap 29A is pressed against the end face 21*a* of the fixing belt 21, which is disposed opposite the end wall 292.

As one of the caps 29A and 29B, that is, the cap 29A, is pressed against the end face 21*a* of the fixing belt 21 with a pressing force, the pressing force presses the fixing belt 21 against another one of the caps 29A and 29B, that is, the cap 29B. Accordingly, the cap 29B is pressed against the side plate 30B that is disposed opposite the cap 29B. As the cap 29B contacts the side plate 30B disposed opposite the cap 29B, the side plate 30B restricts motion of the cap 29B rightward in FIG. 7 in the longitudinal direction X of the fixing belt 21. Hence, the end face 21*b* of the fixing belt 21 is pressed against the end wall 292 of the cap 29B.

As described above, according to the embodiment, the first gear 41 serving as a first helical gear and the second gear 42 serving as a second helical gear that mesh with each other generate the thrust force Fx that presses the caps 29A and 29B against the end faces 21*a* and 21*b* of the fixing belt 21, respectively, thus retaining proper contact of the caps 29A and 29B with the end faces 21*a* and 21*b* of the fixing belt 21, respectively. For example, the caps 29A and 29B are not secured to the side plates 30A and 30B, respectively. The caps 29A and 29B are attached to the fixing belt 21 such that the caps 29A and 29B move in the longitudinal direction X of the fixing belt 21. The thrust force Fx that generates as the first gear 41 rotates presses the cap 29A as a left cap in FIG. 7 against the end face 21*a* of the fixing belt 21, which is disposed opposite the cap 29A. Accordingly, the end face 21*b* of the fixing belt 21, which is opposite to the end face 21*a*, is pressed against the cap 29B disposed opposite the end face 21*b*, thus retaining proper contact of the caps 29A and 29B with the end faces 21*a* and 21*b* of the fixing belt 21, respectively. Even after the pressure roller 22 and the fixing belt 21 stop rotation, the first gear 41 and the second gear 42 that mesh with each other retain a position of the cap 29A mounting the first gear 41 (e.g., a position of the cap 29A in the longitudinal direction X of the fixing belt 21), thus retaining a pressing state in which the caps 29A and 29B press against the end faces 21*a* and 21*b* of the fixing belt 21, respectively, not releasing the pressing state. Accordingly, the lubricant applied within the loop formed by the fixing belt 21 does not leak to an exterior of the fixing belt 21 via the end faces 21*a* and 21*b* thereof and does not enter gaps between the outer circumferential face 21*d* of the fixing belt 21 at both lateral ends of the fixing belt 21 in the longitudinal direction X thereof and the caps 29A and 29B, respectively. Consequently, the lubricant does not adhere to the elastic layers 36A and 36B and the elastic layers 36A and 36B do not slip, improving reliability in detection of rotation of the fixing belt 21.

With the configuration of the fixing device 20 according to the embodiment, the fixing belt 21 partially contacts the elastic layers 36A and 36B, not throughout the entire span of the fixing belt 21 in the rotation direction D21 thereof. The elastic layers 36A and 36B partially contact the caps 29A and 29B, respectively, not throughout the entire span of the fixing belt 21 in the rotation direction D21 thereof. The elastic layers 36A and 36B are not elongated in the longitudinal direction X of the fixing belt 21. However, the fixing device 20 prevents slippage of the elastic layers 36A and 36B. Hence, the fixing device 20 prevents degradation in assembly caused by contact of elements (e.g., the fixing belt 21, the elastic layers 36A and 36B, and the caps 29A and 29B) of the fixing device 20, damage to the fixing belt 21 caused by thermal expansion, and upsizing of the fixing device 20 caused by elongation of the elastic layers 36A and 36B. Thus, the fixing device 20 improves assembly, downsizing, and reliability.

Figure 8:
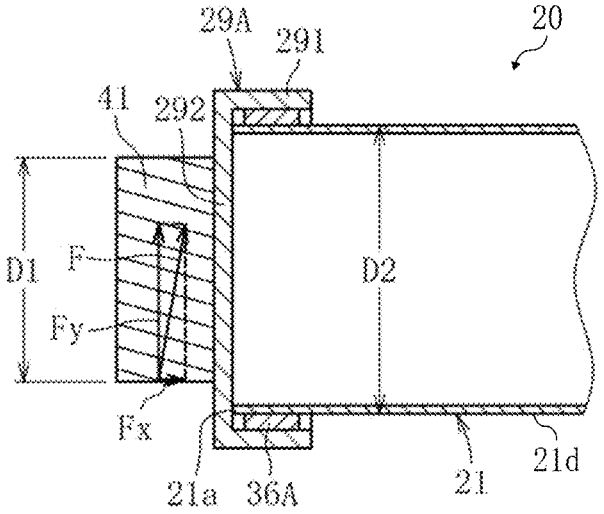
FIG. 8 is a diagram of the fixing device depicted in FIG. 7, illustrating a relation between an outer diameter of a first gear incorporated therein and an inner diameter of the fixing belt.

According to the embodiment, as illustrated in FIG. 8, the first gear 41 has an outer diameter D1 that is not greater than an outer diameter D2 of the fixing belt 21. An outer diameter of a first gear denotes a diameter (e.g., a maximum outer diameter) of an addendum circle that passes through tops of a plurality of teeth of the first gear continuously. An outer diameter of a fixing belt denotes a diameter of an outer circumferential face of the fixing belt in a no-load state in which the fixing belt does not receive pressure from a pressure roller or the like. As described above, according to the embodiment, the outer diameter D1 of the first gear 41 is not greater than the outer diameter D2 of the fixing belt 21. Accordingly, the thrust force Fx of the reactive force F that is received by the first gear 41 from the second gear 42 generates within the loop formed by the fixing belt 21, that is, in an interior defined by the outer circumferential face 21*d* of the fixing belt 21.

Figure 9:
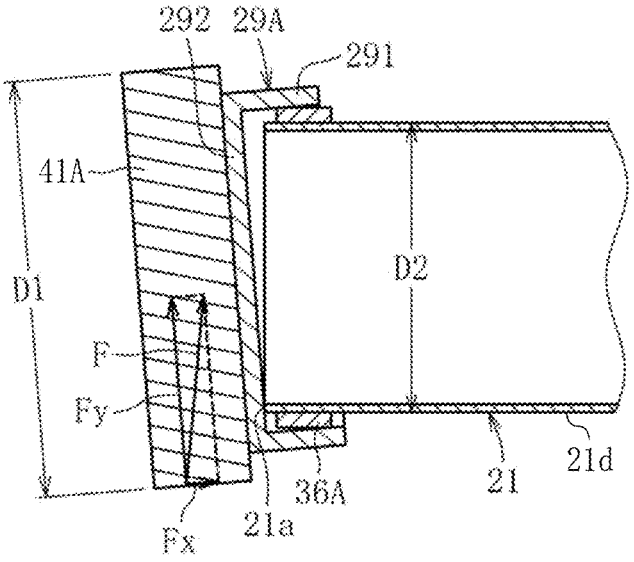
FIG. 9 is a diagram of a comparative first gear.

Conversely, unlike the embodiment, if the outer diameter D1 of a first gear 41A is greater than the outer diameter D2 of the fixing belt 21 as illustrated in FIG. 9, the thrust force Fx generates outside the loop formed by the fixing belt 21, that is, in the exterior defined by the outer circumferential face 21*d* of the fixing belt 21. In this case, as illustrated in FIG. 9, the end face 21*a* of the fixing belt 21 does not receive a load of the thrust force Fx stably, destabilizing a posture of the cap 29A.

As described above, with the first gear 41A depicted in FIG. 9, since the posture of the cap 29A is unstable, the cap 29A may not prevent the lubricant from entering the gap between the end face 21*a* of the fixing belt 21 and the cap 29A effectively. Conversely, with the first gear 41 depicted in FIG. 8, unlike with the first gear 41A depicted in FIG. 9, the thrust force Fx generates within the loop formed by the fixing belt 21, that is, in the interior defined by the outer circumferential face 21*d* of the fixing belt 21. Accordingly, the cap 29A contacts the end face 21*a* of the fixing belt 21 stably. Consequently, the cap 29A prevents the lubricant from entering the gap between the end face 21*a* of the fixing belt 21 and the cap 29A effectively.

Unlike the fixing belt 21 according to the embodiment that is thin and has a thickness of approximately 1 mm, if a rotator having an increased thickness such as a fixing roller is employed, an inner diameter of the rotator is different from an outer diameter of the rotator. Hence, the outer diameter D1 of the first gear 41 may be greater than the inner diameter of the rotator. In this case also, the outer diameter D1 of the first gear 41 is not greater than the outer diameter D2 of the rotator. Since the outer diameter D1 of the first gear 41 is not greater than the outer diameter D2 of the rotator, like in the embodiment described above, the cap 29A contacts the end face 21*a* of the fixing belt 21 stably.

Figure 10:
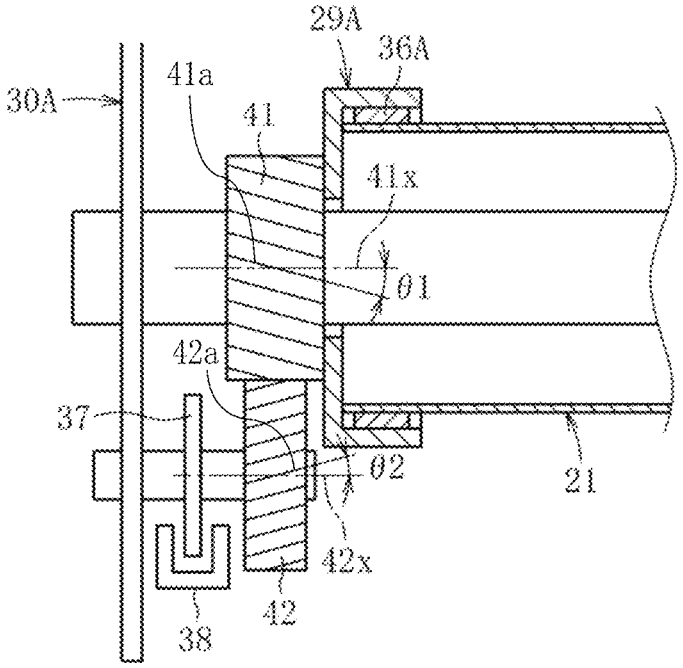
FIG. 10 is a diagram of the first gear and a second gear incorporated in the fixing device depicted in FIG. 7, illustrating angles of inclination of the first gear and the second gear, respectively.

As illustrated in FIGS. 7 and 10, the teeth 41*a* of the first gear 41 and the teeth 42*a* of the second gear 42 define angles of inclination θ1 and θ2 (e.g., helix angles) with respect to the rotation shaft 41*x* of the first gear 41 and a rotation shaft 42*x* of the second gear 42, respectively. The angles of inclination θ1 and θ2 are preferably not smaller than 1 degree and not greater than 30 degrees. For example, the angle of inclination θ1 is not smaller than 1 degree and the angle of inclination θ2 is not greater than 30 degrees. If the angles of inclination θ1 and θ2 of the teeth 41*a* of the first gear 41 and the teeth 42*a* of the second gear 42, respectively, are smaller than 1 degree, the thrust force Fx that presses the cap 29A against the end face 21*a* of the fixing belt 21 may not be obtained effectively. Conversely, if the angles of inclination θ1 and θ2 of the teeth 41*a* of the first gear 41 and the teeth 42*a* of the second gear 42, respectively, are greater than 30 degrees, the thrust force Fx may increase excessively, damaging the fixing belt 21. To address circumstances described above, the angles of inclination θ1 and θ2 of the teeth 41*a* of the first gear 41 and the teeth 42*a* of the second gear 42, respectively, are not smaller than 1 degree and not greater than 30 degrees. Accordingly, while the first gear 41 and the second gear 42 suppress damage or breakage of the fixing belt 21, the first gear 41 and the second gear 42 bring the caps 29A and 29B into contact with the end faces 21*a* and 21*b* of the fixing belt 21, respectively, thus effectively preventing the lubricant from entering the gaps between the end faces 21*a* and 21*b* of the fixing belt 21 and the caps 29A and 29B, respectively. In order to prevent the lubricant from entering the gaps more effectively, the angles of inclination θ1 and θ2 of the teeth 41*a* of the first gear 41 and the teeth 42*a* of the second gear 42, respectively, are preferably not smaller than 10 degrees and not greater than 20 degrees. For example, the angle of inclination θ1 is not smaller than 10 degrees and the angle of inclination θ2 is not greater than 20 degrees.

The orientations of the teeth 41*a* of the first gear 41 and the teeth 42*a* of the second gear 42 are not limited to orientations illustrated in FIG. 10, respectively. The direction of the thrust force Fx that generates on the first gear 41 varies depending on rotation directions of the fixing belt 21 and the pressure roller 22 when the fixing belt 21 and the pressure roller 22 convey the sheet P through the fixing nip N. If the fixing device 20 has a configuration in which the fixing belt 21 and the pressure roller 22 rotate in rotation directions opposite to the rotation directions D21 and D22 depicted in FIG. 2, respectively, the teeth 41*a* of the first gear 41 and the teeth 42*a* of the second gear 42 are inclined in orientations opposite to the orientations illustrated in FIG. 10, respectively. Accordingly, the orientations of the teeth 41*a* of the first gear 41 and the teeth 42*a* of the second gear 42 are set properly according to the rotation directions of the fixing belt 21 and the pressure roller 22 when the fixing belt 21 and the pressure roller 22 convey the sheet P to fix the toner image on the sheet P.

If the fixing belt 21 includes the base layer 210 made of the metal material, the fixing belt 21 achieves an enhanced strength that causes the fixing belt 21 to be insusceptible to breakage due to friction or the like. Conversely, if the base layer 210 of the fixing belt 21 is made of the resin material such as polyimide, compared to the fixing belt 20 including the base layer 210 made of metal, the fixing belt 21 has a decreased rigidity. Accordingly, the caps 29A and 29B readily contact the end faces 21*a* and 21*b* of the fixing belt 21, respectively, improving contact therewith.

Figure 11:
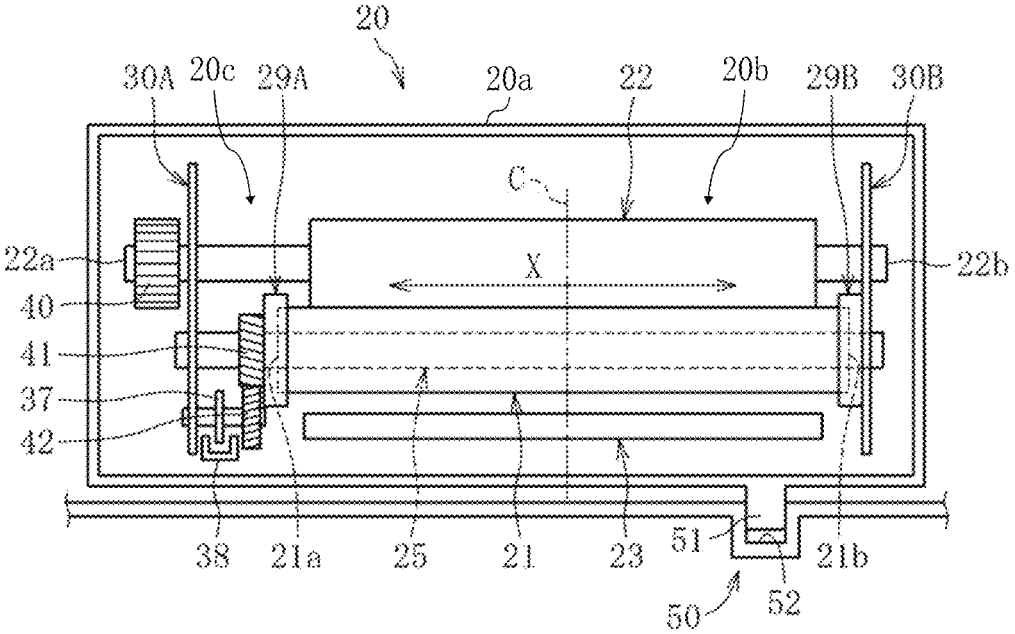
FIG. 11 is a diagram of the fixing device depicted in FIG. 4, illustrating a positioner that is incorporated in the image forming apparatus depicted in FIG. 1 and positions the fixing device with respect to a body of the image forming apparatus.

As illustrated in FIG. 11, the image forming apparatus 100 further includes a positioner 50 that positions the fixing device 20 with respect to the body of the image forming apparatus 100 in the longitudinal direction X of the fixing belt 21. The positioner 50 is preferably disposed opposite the first gear 41 via the center C of the fixing belt 21 in the longitudinal direction X thereof. For example, the positioner 50 includes a positioning projection 51 and a positioning recess 52. The positioning projection 51 is disposed in an exterior (e.g., a frame) of the fixing device 20. The positioning recess 52 is disposed in the body of the image forming apparatus 100 and engages the positioning projection 51. Alternatively, a positional relation between the positioning projection 51 and the positioning recess 52 of the positioner 50 may be reverse to a positional relation therebetween depicted in FIG. 11. For example, the positioning recess 52 may be disposed in the exterior of the fixing device 20 and the positioning projection 51 may be disposed in the body of the image forming apparatus 100.

Like in the embodiment described above, also in a construction depicted in FIG. 11, as the pressure roller 22 rotates, the pressure roller 22 drives and rotates the fixing belt 21. The thrust force Fx generates at the meshing portion where the first gear 41 meshes with the second gear 42. The thrust force Fx presses the cap 29A, that is, one of the caps 29A and 29B (e.g., a left cap in FIG. 11), against the end face 21*a* of the fixing belt 21. The thrust force Fx presses the cap 29B, that is, another one of the caps 29A and 29B (e.g., a right cap in FIG. 11), against the side plate 308 disposed opposite the cap 29B. The fixing belt 21 is positioned in a right side in FIG. 11 that is defined by the center C of the fixing belt 21 in the longitudinal direction X thereof, where the cap 29B is disposed.

As described above, with the configuration depicted in FIG. 11, the first gear 41 is disposed opposite the positioner 50 via the center C of the fixing belt 21 in the longitudinal direction X thereof. The fixing device 20 has a fixing belt positioning position where the fixing belt 21 is positioned (e.g., a contact position where the cap 29B contacts the side plate 30B) and a fixing device positioning position where the fixing device 20 is positioned by the positioner 50. The fixing device 20 further includes a housing 20*a* including one region 20*b* (e.g., the right side in FIG. 11 that is defined by the center C of the fixing belt 21 in the longitudinal direction X thereof) and another region 20*c* (e.g., a left side in FIG. 11 that is defined by the center C of the fixing belt 21 in the longitudinal direction X thereof). The fixing belt positioning position is situated in the identical region 20*b* where the fixing device positioning position is situated. Since the fixing belt positioning position where the fixing belt 21 is positioned is disposed in proximity to the fixing device positioning position where the fixing device 20 is positioned, the fixing belt positioning position shifts less relative to the fixing device positioning position. As a result, the fixing belt 21 shifts less relative to the body of the image forming apparatus 100, improving accuracy in positioning the fixing belt 21.

In order to downsize the fixing device 20, as illustrated in FIG. 11, the driving force transmitting gear 40, the first gear 41, and the second gear 42 are preferably disposed in the identical region 20*c* defined by the center C of the fixing belt 21 in the longitudinal direction X thereof. If the driving force transmitting gear 40, the first gear 41, and the second gear 42 are disposed in the identical region 20*c* defined by the center C of the fixing belt 21 in the longitudinal direction X thereof, in addition to a gear that meshes with the driving force transmitting gear 40 and is disposed in the body of the image forming apparatus 100 and the driver, the rotary member 37 mounting the second gear 42, the photo interrupter 38 that detects rotation of the rotary member 37, and the like are disposed in the identical region 20*c* defined by the center C of the fixing belt 21 in the longitudinal direction X thereof. Hence, installation space where wires coupled to a power supply, the photo interrupter 38, and the like are placed is integrated, downsizing the image forming apparatus 100.

Figure 12:
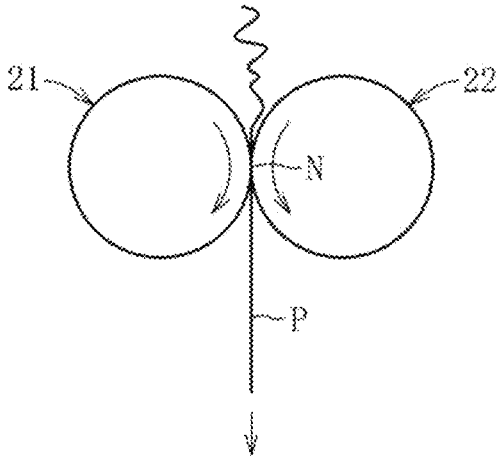
FIG. 12 is a diagram of the fixing belt and the pressure roller depicted in FIG. 4 that rotate backward as one example.

The fixing belt 21 and the pressure roller 22 of the fixing device 20 may also rotate in rotation directions opposite to the rotation directions D21 and D22, respectively, in which the fixing belt 21 and the pressure roller 22 rotate to fix the toner image on the sheet P. For example, as illustrated in FIG. 12, in order to facilitate removal of the sheet P jammed at the fixing nip N, the fixing belt 21 and the pressure roller 22 rotate backward to move the sheet P to an upstream position disposed upstream from the fixing nip N in the sheet conveyance direction DP of the sheet P depicted in FIG. 2.

Figure 13:
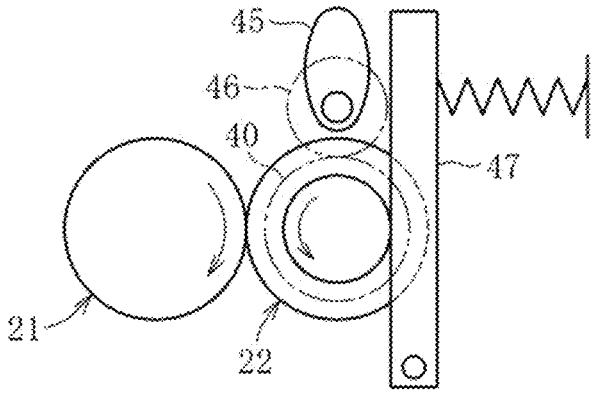
FIG. 13 is a diagram of the fixing belt and the pressure roller depicted in FIG. 4 that rotate backward as another example.

As a variation of the fixing device 20, FIG. 13 illustrates a construction in which pressure applied by the pressure roller 22 to the fixing belt 21 is released. When the fixing device 20 is left unused for a prolonged period of time, the elastic layer 221 of the pressure roller 22 may suffer from plastic deformation at a pressing position where the pressure roller 22 presses against the fixing belt 21, causing noise and faulty image formation. To address this circumstance, pressure applied by the pressure roller 22 to the fixing belt 21 is released to prevent plastic deformation of the pressure roller 22. Alternatively, in order to facilitate removal of the sheet P jammed at the fixing nip N, pressure applied by the pressure roller 22 to the fixing belt 21 may be released.

Figure 14:
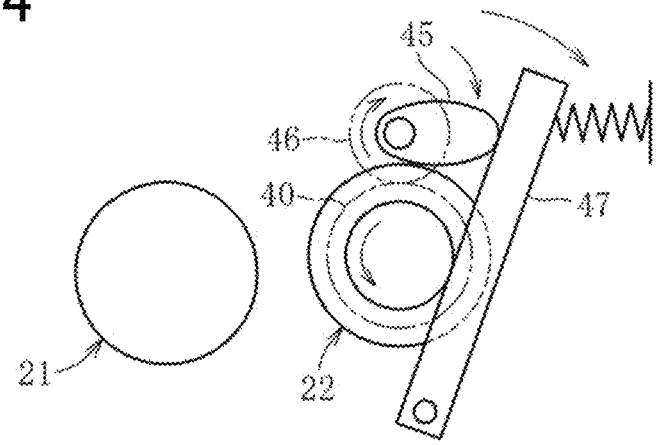
FIG. 14 is a diagram of the fixing belt and the pressure roller depicted in FIG. 13, illustrating a state in which pressure applied by the pressure roller is released.

FIG. 13 illustrates a construction of the fixing device 20 further including a cam 45 that releases pressure applied by the pressure roller 22 to the fixing belt 21. The cam 45 mounts a cam gear 46 that meshes with the driving force transmitting gear 40 mounted on the pressure roller 22. In order to release pressure applied by the pressure roller 22 to the fixing belt 21, the pressure roller 22 rotates backward in a direction indicated by arrow in FIG. 13 to pivot the cam 45 in a pivot direction indicated by arrow in FIG. 14. Accordingly, the cam 45 presses and moves a lever 47 contacting the pressure roller 22 to separate the pressure roller 22 from the fixing belt 21, thus releasing pressure applied by the pressure roller 22 to the fixing belt 21. Before the pressure roller 22 separates from the fixing belt 21 entirely, a driving force is transmitted from the pressure roller 22 to the fixing belt 21. Hence, as the pressure roller 22 rotates backward, the fixing belt 21 also rotates backward.

As described above, the fixing device 20 has the construction in which the fixing belt 21 and the pressure roller 22 rotate backward for various objectives. However, according to the embodiments of the present disclosure described above, if the fixing belt 21 and the pressure roller 22 rotate backward, a disadvantage may occur as described below.

Figure 15:
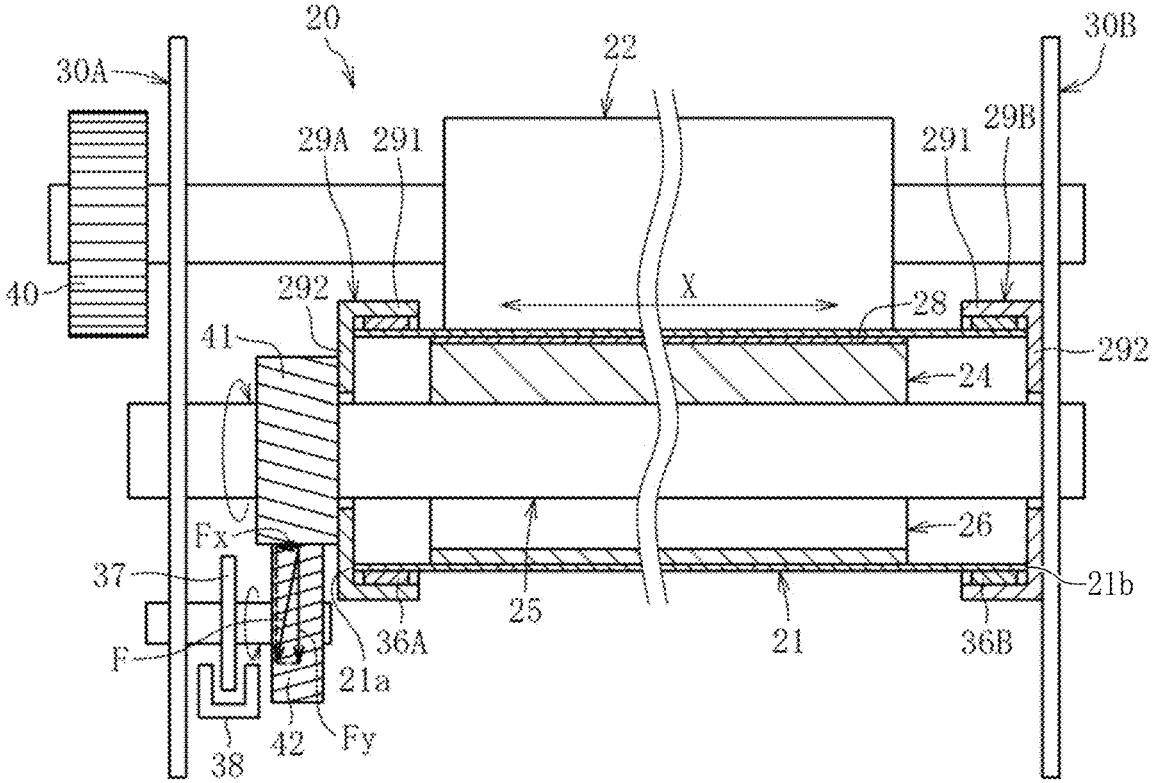
FIG. 15 is a diagram of the fixing device depicted in FIG. 7, illustrating a disadvantage caused by backward rotation of the fixing belt and the pressure roller.

According to the embodiments of the present disclosure, each of the first gear 41 and the second gear 42 is the helical gear. Accordingly, as the pressure roller 22 and the fixing belt 21 rotate backward, the thrust force Fx that generates at the meshing portion where the first gear 41 meshes with the second gear 42 is oriented in an opposite direction opposite to the direction in which the thrust force Fx is oriented when the pressure roller 22 and the fixing belt 21 rotate forward as illustrated in FIG. 7. For example, as illustrated in FIG. 15, as the pressure roller 22 and the fixing belt 21 rotate backward, the first gear 41 and the second gear 42 rotate backward. Accordingly, at the meshing portion where the first gear 41 meshes with the second gear 42, the thrust force Fx generates in a direction in which the cap 29A separates from the end face 21*a* of the fixing belt 21. Consequently, if the pressure roller 22 and the fixing belt 21 rotate backward, the caps 29A and 29B may not retain proper contact with the end faces 21*a* and 21*b* of the fixing belt 21, respectively.

As a method for suppressing the disadvantage caused by backward rotation of the pressure roller 22 and the fixing belt 21, a rotation time period of backward rotation is shortened. As the fixing belt 21 and the pressure roller 22 rotate backward for the shortened rotation time period, the thrust force Fx generates for a shortened time period at the meshing portion where the first gear 41 meshes with the second gear 42. Accordingly, the cap 29A does not separate from the end face 21*a* of the fixing belt 21 easily. For example, a rotation time period for which the fixing belt 21 and the pressure roller 22 rotate backward is preferably shorter than a rotation time period (e.g., a rotation time period for forward rotation) when the fixing belt 21 and the pressure roller 22 rotate forward to fix a toner image on a single sheet P.

Alternatively, a rotation speed at which the fixing belt 21 and the pressure roller 22 rotate backward may be slower than a rotation speed (e.g., a rotation speed for forward rotation) when the fixing belt 21 and the pressure roller 22 rotate forward to fix a toner image on a sheet P. In this case, a torque of the fixing belt 21 and the pressure roller 22 that rotate backward is smaller than a torque of the fixing belt 21 and the pressure roller 22 that rotate forward. Hence, the reactive force F received by the first gear 41 also decreases. The thrust force Fx in the direction in which the cap 29A separates from the end face 21*a* of the fixing belt 21 also decreases. Accordingly, as the fixing belt 21 and the pressure roller 22 rotate backward at a decreased rotation speed, the cap 29A does not separate from the end face 21*a* of the fixing belt 21 easily.

As another method for suppressing the disadvantage caused by backward rotation of the pressure roller 22 and the fixing belt 21, a one-way clutch is employed as a one-way torque transmitter that transmits a torque in one direction and does not transmit the torque in an opposite direction opposite to the one direction.

Figure 16:
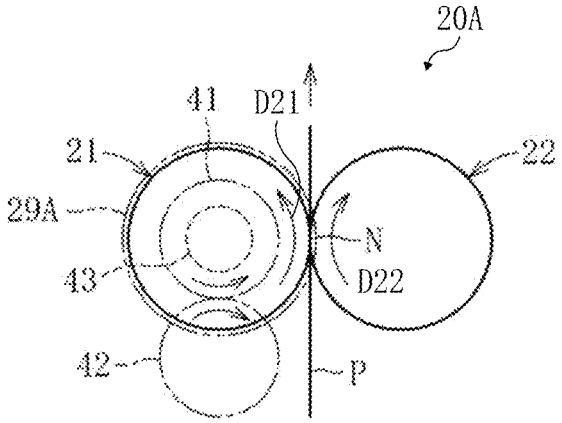
FIG. 16 is a diagram of a fixing device as a variation of the fixing device depicted in FIG. 2, illustrating a one-way clutch that is incorporated in the fixing device and is attached to the first gear.

FIG. 16 illustrates a fixing device 20A including a one-way clutch 43 that is attached to the first gear 41 and transmits a torque that rotates the cap 29A forward to the first gear 41. In this case, as illustrated in FIG. 16, as the fixing belt 21 and the pressure roller 22 rotate in the rotation directions D21 and D22, respectively, to convey a sheet P through the fixing nip N so as to fix a toner image on the sheet P, the one-way clutch 43 transmits the torque that rotates the cap 29A forward to the first gear 41. Accordingly, when the cap 29A rotates forward, the first gear 41 and the second gear 42 rotate. At the meshing portion where the first gear 41 meshes with the second gear 42, the thrust force Fx generates in a direction in which the cap 29A moves toward the end face 21*a* of the fixing belt 21.

Figure 17:
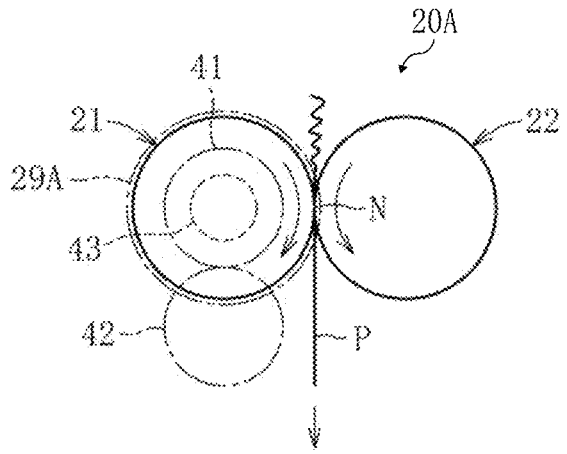
FIG. 17 is a diagram of the fixing device depicted in FIG. 16, illustrating an operation of the one-way clutch when the fixing belt and the pressure roller rotate backward.

Conversely, as illustrated in FIG. 17, when the cap 29A rotates backward, the one-way clutch 43 does not transmit a torque that rotates the cap 29A backward to the first gear 41 from the cap 29A. Hence, the first gear 41 and the second gear 42 do not rotate backward. Accordingly, when the cap 29A rotates backward, at the meshing portion where the first gear 41 meshes with the second gear 42, the thrust force Fx does not generate in the direction in which the cap 29A separates from the end face 21*a* of the fixing belt 21, preventing the cap 29A from separating from the end face 21*a* of the fixing belt 21.

Figure 18:
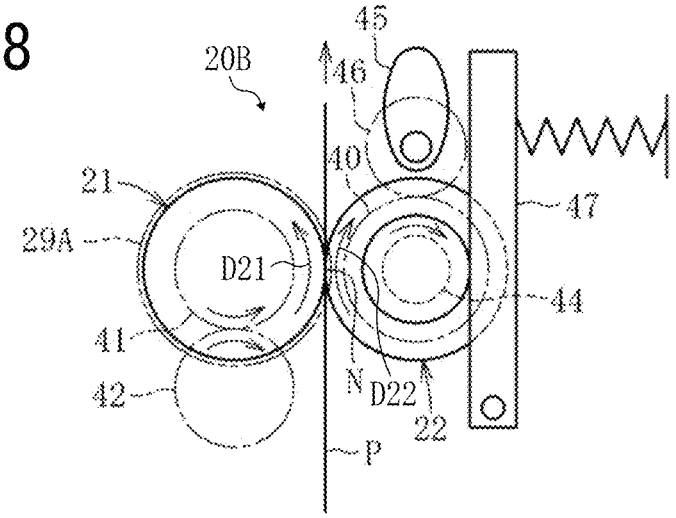
FIG. 18 is a diagram of a fixing device as another variation of the fixing device depicted in FIG. 2, illustrating a one-way clutch that is incorporated in the fixing device and is attached to a driving force transmitting gear incorporated in the fixing device.

FIG. 18 illustrates a fixing device 20B including a one-way clutch 44 that is attached to the driving force transmitting gear 40 and transmits a torque that rotates the driving force transmitting gear 40 forward to the pressure roller 22. In this case, as illustrated in FIG. 18, when the driving force transmitting gear 40 rotates forward, the one-way clutch 44 transmits a torque that rotates the driving force transmitting gear 40 forward to the pressure roller 22 from the driving force transmitting gear 40. Accordingly, the pressure roller 22 and the fixing belt 21 rotate forward in the rotation directions D22 and D21, respectively, to convey a sheet P through the fixing nip N. Since the cam gear 46 mounts another one-way clutch that does not transmit a torque that rotates the driving force transmitting gear 40 forward, the cam 45 does not rotate. The first gear 41 and the second gear 42 rotate in accordance with rotation of the fixing belt 21. Hence, at the meshing portion where the first gear 41 meshes with the second gear 42, the thrust force Fx generates in the direction in which the cap 29A moves toward the end face 21*a* of the fixing belt 21.

Figure 19:
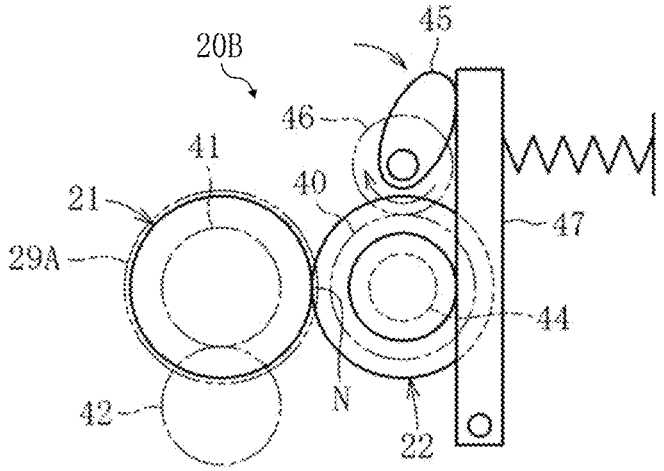
FIG. 19 is a diagram of the fixing device depicted in FIG. 18, illustrating an operation of the one-way clutch when the fixing belt and the pressure roller rotate backward.

Conversely, as illustrated in FIG. 19, when the driving force transmitting gear 40 rotates backward, the one-way clutch 44 does not transmit a torque that rotates the driving force transmitting gear 40 backward to the pressure roller 22 from the driving force transmitting gear 40. Hence, the pressure roller 22 and the fixing belt 21 do not rotate backward. Accordingly, the first gear 41 and the second gear 42 also do not rotate backward. The thrust force Fx also does not generate in the direction in which the cap 29A separates from the end face 21*a* of the fixing belt 21, preventing the cap 29A from separating from the end face 21*a* of the fixing belt 21. As the driving force transmitting gear 40 rotates backward, the cam 45 rotates. The cam 45 presses and moves the lever 47 to release pressure applied by the pressure roller 22 to the fixing belt 21.

Unlike the one-way clutch 43 depicted in FIGS. 16 and 17, the one-way clutch 44 depicted in FIGS. 18 and 19 does not rotate the fixing belt 21 and the pressure roller 22 backward when the driving force transmitting gear 40 rotates backward. Accordingly, in order to rotate the fixing belt 21 and the pressure roller 22 backward to facilitate removal of the sheet P jammed at the fixing nip N, the one-way clutch 43 depicted in FIGS. 16 and 17 is employed. Alternatively, the one-way clutch 44 depicted in FIGS. 18 and 19 may be attached to the first gear 41 instead of the driving force transmitting gear 40, like the one-way clutch 43 depicted in FIGS. 16 and 17.

The above describes the embodiments of the present disclosure. However, the technology of the present disclosure is not limited to the embodiments described above and is modified within the scope of the present disclosure.

For example, the technology of the present disclosure is also applied to fixing devices 60, 60A, 608, 60C, and 60D illustrated in FIGS. 20 to 25. The following describes a construction of each of the fixing devices 60, 60A, 60B, 60C, and 60D illustrated in FIGS. 20 to 25.

A description is provided of the construction of the fixing device 60 according to an embodiment of the present disclosure.

Figure 20:
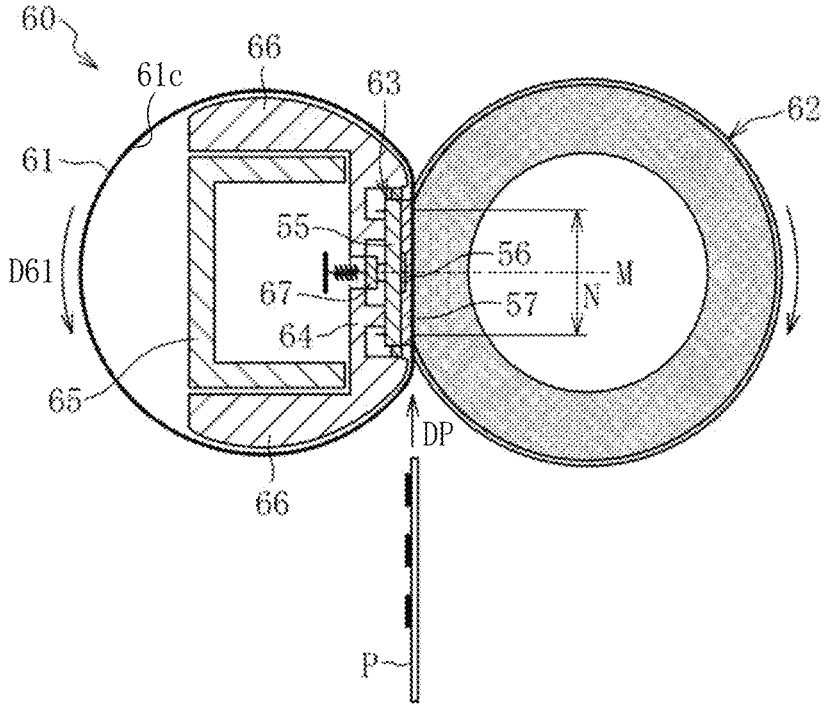
FIG. 20 is a schematic cross-sectional view of a fixing device according to another embodiment of the present disclosure that is installable in the image forming apparatus depicted in FIG. 1.

As illustrated in FIG. 20, the fixing device 60 includes a fixing belt 61 and a heater 63 instead of the electromagnetic induction heater 23 depicted in FIG. 2 according to the embodiment described above. The heater 63 is planar or platy and includes a base 55 and a plurality of resistive heat generators 56 mounted on the base 55. The base 55 is made of ceramics such as alumina and aluminum nitride or a material that is heat-resistant and insulative such as glass, mica, and polyimide. The base 55 may be constructed of a metal layer made of metal such as stainless steel, iron, and aluminum and an insulating layer mounted on the metal layer. Each of the resistive heat generators 56 is produced as below. Silver-palladium (AgPd), glass powder, and the like are mixed into paste. The paste coats the base 55 by screen printing or the like. Thereafter, the base 55 is subject to firing. The resistive heat generators 56 are covered by an insulating layer 57. The insulating layer 57 is made of heat-resistant glass, ceramics, polyimide, or the like.

Figure 21:
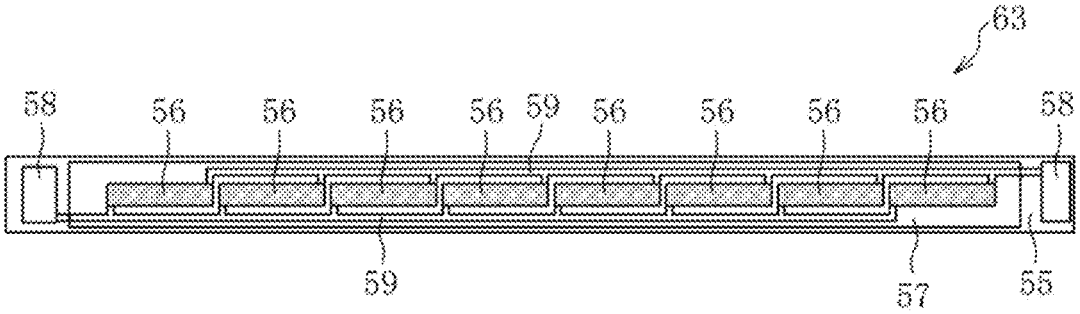
FIG. 21 is a plan view of a heater incorporated in the fixing device depicted in FIG. 20.

As illustrated in FIG. 21, the heater 63 is platy and rectangular. The heater 63 has a longitudinal direction that is parallel to a longitudinal direction of the fixing belt 61. The plurality of resistive heat generators 56 is arranged on the base 55 in the longitudinal direction of the heater 63 with a gap between the adjacent resistive heat generators 56. The base 55 has a mounting face that mounts the resistive heat generators 56. The mounting face also mounts a plurality of electrodes 58 and a plurality of feeders 59. The resistive heat generators 56 are electrically connected in parallel to the electrodes 58 through the feeders 59. The electrodes 58 are disposed at both lateral ends of the base 55 in a longitudinal direction thereof, respectively. The insulating layer 57 covers the resistive heat generators 56 and the feeders 59. Conversely, since each of the electrodes 58 is electrically connected to a connector serving as a terminal, each of the electrodes 58 is not covered by the insulating layer 57 and is exposed.

As illustrated in FIG. 20, the fixing device 60 further includes a heater holder 64 that holds or supports the heater 63. The heater 63 contacts an inner circumferential face 61*c* of the fixing belt 61. Hence, as the heater 63 generates heat, the heater 63 heats the inner circumferential face 61*c* of the fixing belt 61. Like the fixing belt 21 according to the embodiment described above with reference to FIG. 2, the fixing belt 61 is an endless belt that includes a base layer, an elastic layer, and a release layer. However, the fixing belt 61 does not include a heat generating layer that generates heat by electromagnetic induction heating. The base layer, the elastic layer, and the release layer of the fixing belt 61 are made of materials that are similar to the materials of the base layer 210, the elastic layer 212, and the release layer 213 of the fixing belt 21 according to the embodiment described above with reference to FIG. 3.

The fixing device 60 further includes a pressure roller 62 that is pressed against the heater 63 via the fixing belt 61 at a contact portion where the heater 63 contacts the fixing belt 61. Thus, the fixing nip N is formed between the fixing belt 61 and the pressure roller 62. The pressure roller 62 basically has a construction equivalent to the construction of the pressure roller 22 according to the embodiment described above with reference to FIG. 2.

The heater holder 64 is disposed within a loop formed by the fixing belt 61 and holds the heater 63. Since the heater holder 64 is subject to a high temperature by heat from the heater 63, the heater holder 64 is preferably made of a heat-resistant material. For example, if the heater holder 64 is made of heat-resistant resin having a decreased thermal conductivity, such as liquid crystal polymer (LCP) and PEEK, while the heater holder 64 attains heat resistance, the heater holder 64 suppresses conduction of heat thereto from the heater 63, facilitating heating of the fixing belt 61.

The fixing device 60 further includes a stay 65 serving as a support that supports the heater holder 64. The stay 65 is disposed within the loop formed by the fixing belt 61. The stay 65 supports an opposite face of the heater holder 64, which is opposite to a nip opposed face of the heater holder 64, which is disposed opposite the fixing nip N. Thus, the stay 65 prevents the heater holder 64 from being bent by pressure from the pressure roller 62 throughout an entire span of the heater holder 64 in the longitudinal direction of the fixing belt 61. Accordingly, the fixing nip N, having an even length in the sheet conveyance direction DP throughout an entire span of the fixing belt 61 in the longitudinal direction thereof, is formed between the fixing belt 61 and the pressure roller 62. The stay 65 is preferably made of a ferrous metal material such as stainless steel and SECC to achieve rigidity.

The heater holder 64 is combined with guides 66. The guides 66 are disposed upstream and downstream from the fixing nip N in a rotation direction D61 of the fixing belt 61. While the fixing belt 61 rotates, the guides 66 contact and guide the inner circumferential face 61*c* of the fixing belt 61.

The fixing device 60 further includes a temperature sensor 67 that is disposed within the loop formed by the fixing belt 61 and serves as a temperature detector that detects a temperature of the heater 63. The temperature sensor 67 depicted in FIG. 20 is a contact type temperature sensor that contacts an opposite face of the heater 63, which is opposite to a nip opposed face of the heater 63, which is disposed opposite the fixing nip N, and detects the temperature of the heater 63. Alternatively, the temperature sensor 67 may be a non-contact type temperature sensor that does not contact the heater 63 and detects an ambient temperature at a position in proximity to the heater 63.

As the power supply disposed in the body of the image forming apparatus 100 supplies power to the heater 63 of the fixing device 60 according to the embodiment, the resistive heat generators 56 generate heat. Thus, the resistive heat generators 56 heat the fixing belt 61. The controller controls a heat generation amount of the heater 63 based on the temperature of the heater 63, which is detected by the temperature sensor 67, thus retaining the predetermined temperature (e.g., the fixing temperature) of the fixing belt 61. In a state in which the fixing belt 61 retains the predetermined temperature, as illustrated in FIG. 20, while a sheet P bearing an unfixed toner image enters the fixing nip N formed between the fixing belt 61 and the pressure roller 62, the fixing belt 61 and the pressure roller 62 fix the unfixed toner image on the sheet P under heat and pressure.

A description is provided of the construction of the fixing device 60A according to an embodiment of the present disclosure.

Figure 22:
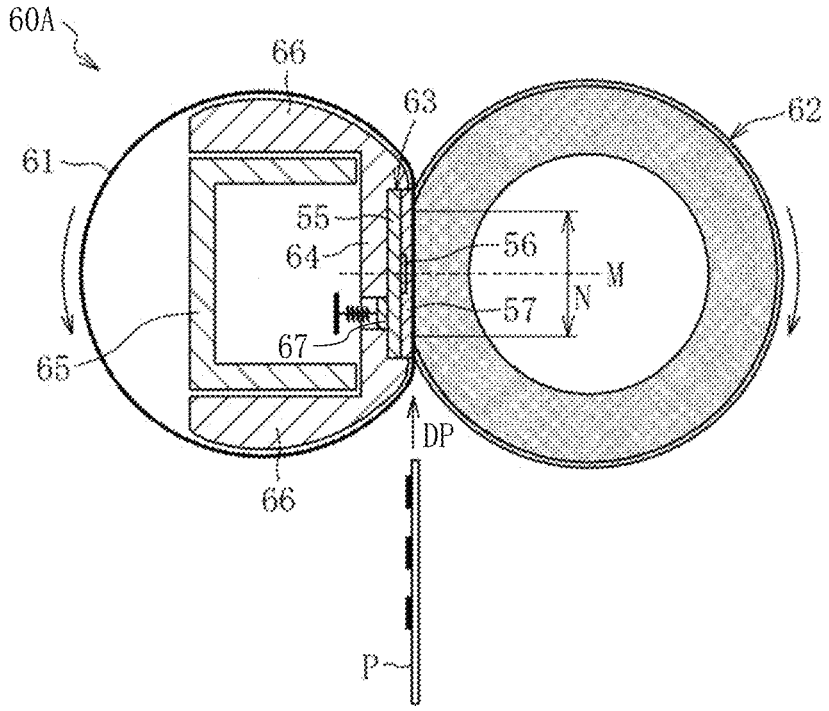
FIG. 22 is a schematic cross-sectional view of a fixing device according to yet another embodiment of the present disclosure that is installable in the image forming apparatus depicted in FIG. 1.

As illustrated in FIG. 20, the temperature sensor 67 of the fixing device 60 is situated on a hypothetical center line M of the fixing nip N in the sheet conveyance direction DP. Alternatively, as illustrated in FIG. 22, the temperature sensor 67 of the fixing device 60A may be situated upstream from the hypothetical center line M of the fixing nip N in the sheet conveyance direction DP. In other words, the temperature sensor 67 may be situated in proximity to an entry to the fixing nip N. At the entry to the fixing nip N, a sheet P entering the fixing nip N draws heat from the fixing belt 61 easily. To address this circumstance, the temperature sensor 67 detects the temperature of the heater 63 at a position in proximity to the entry to the fixing nip N, thus achieving a fixing property of causing the heater 63 to heat the fixing belt 61 to fix a toner image on the sheet P and effectively suppressing a fixing offset of heating the toner image insufficiently.

A description is provided of the construction of the fixing device 60B according to an embodiment of the present disclosure.

Figure 23:
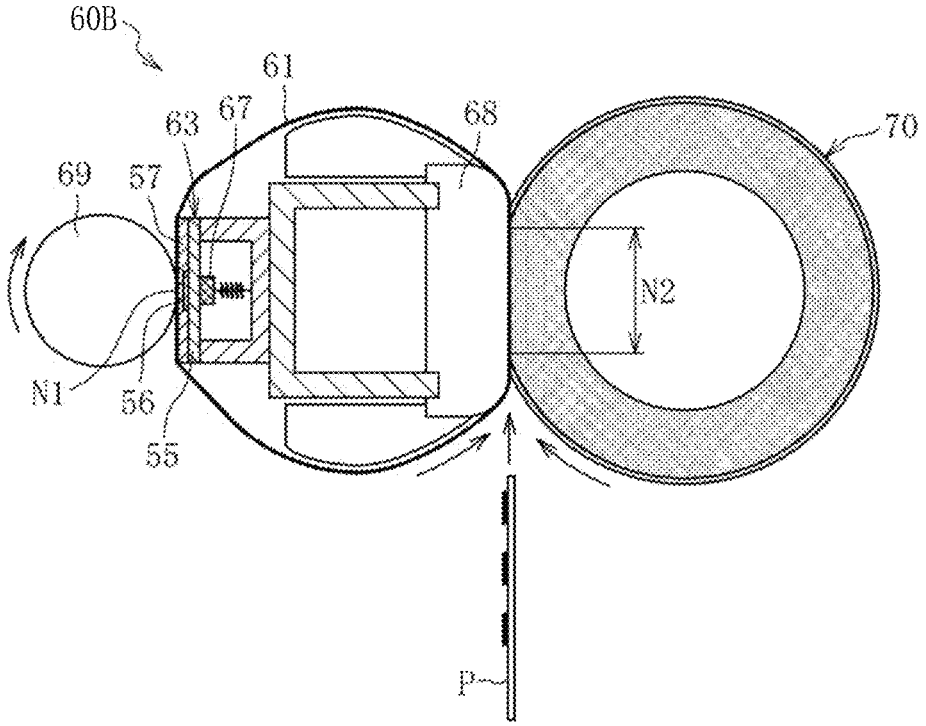
FIG. 23 is a schematic cross-sectional view of a fixing device according to yet another embodiment of the present disclosure that is installable in the image forming apparatus depicted in FIG. 1.

As illustrated in FIG. 23, the fixing device 60B includes a pressure roller 70 and has a heating nip N1 and a fixing nip N2 disposed separately from the heating nip N1. The heater 63 heats the fixing belt 61 that passes through the heating nip N1. The fixing belt 61 and the pressure roller 70 convey a sheet P through the fixing nip N2. For example, the fixing device 60B according to the embodiment further includes a nip formation pad 68 that is disposed within the loop formed by the fixing belt 61 in addition to the heater 63. The fixing device 60B further includes a pressure roller 69. The pressure rollers 69 and 70 are pressed against the heater 63 and the nip formation pad 68, respectively, via the fixing belt 61, thus forming the heating nip N1 and the fixing nip N2.

A description is provided of the construction of the fixing device 60C according to an embodiment of the present disclosure.

Figure 24:
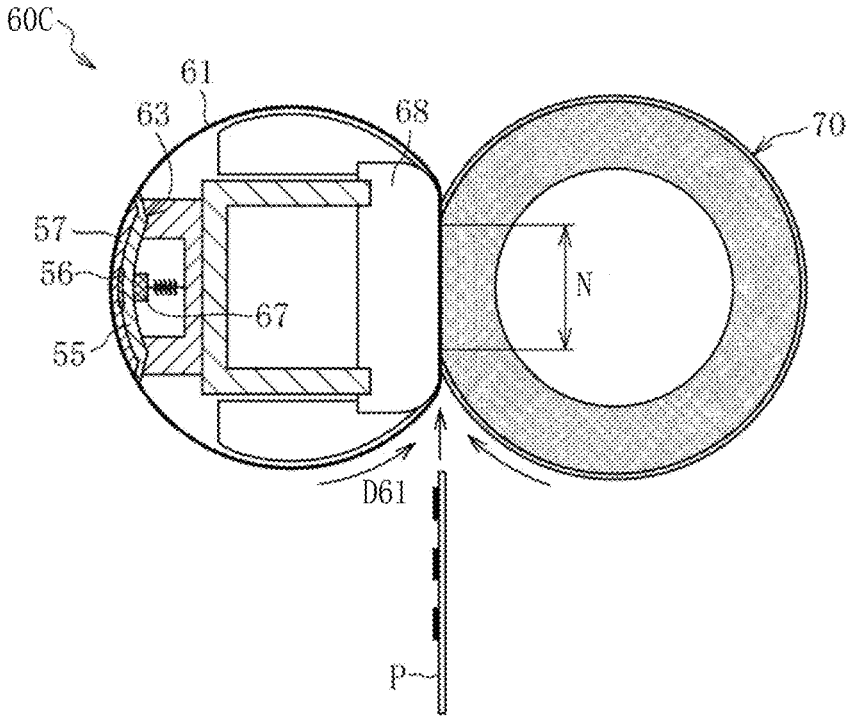
FIG. 24 is a schematic cross-sectional view of a fixing device according to yet another embodiment of the present disclosure that is installable in the image forming apparatus depicted in FIG. 1.

As illustrated in FIG. 24, the fixing device 60C does not incorporate the pressure roller 69 that is disposed opposite the heater 63 as illustrated in FIG. 23. The heater 63 is curved into an arc in cross section that corresponds to a curvature of the fixing belt 61. Other construction of the fixing device 60C is equivalent to the construction of the fixing device 60B depicted in FIG. 23. Since the heater 63 is curved into the arc in cross section, the heater 63 contacts the fixing belt 61 for a sufficient contact length in the rotation direction D61 of the fixing belt 61, heating the fixing belt 61 efficiently.

A description is provided of the construction of the fixing device 60D according to an embodiment of the present disclosure.

Figure 25:
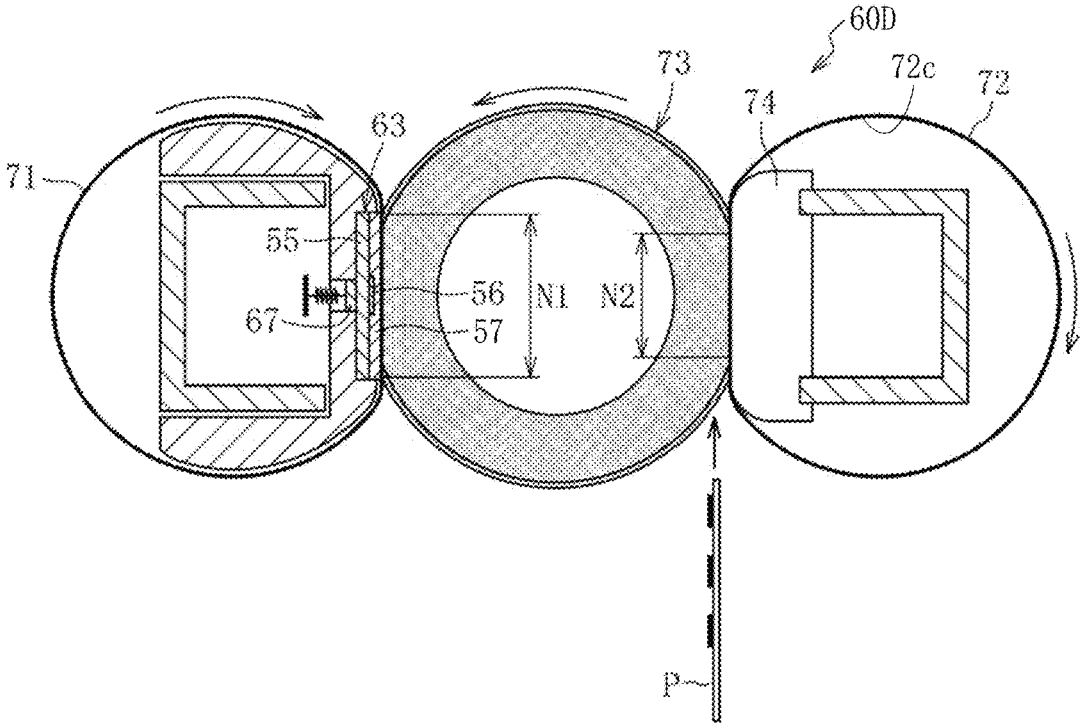
FIG. 25 is a schematic cross-sectional view of a fixing device according to yet another embodiment of the present disclosure that is installable in the image forming apparatus depicted in FIG. 1.

As illustrated in FIG. 25, the fixing device 60D includes a pair of belts 71 and 72 and a roller 73 (e.g., a pressure roller) that is interposed between the belts 71 and 72. The heater 63 is disposed within a loop formed by the belt 71 on the left of the roller 73 in FIG. 25. The heater 63 presses against the roller 73 via the belt 71, forming the heating nip N1 where the heater 63 heats the belt 71 and the roller 73. The fixing device 60D further includes a nip formation pad 74 that is disposed within a loop formed by the belt 72 on the right of the roller 73 in FIG. 25. The nip formation pad 74 contacts an inner circumferential face 72*c* of the belt 72 and presses against the roller 73 via the belt 72, forming the fixing nip N2 where the roller 73 and the belt 72 fix a toner image on a sheet P.

An image forming apparatus applied with the embodiments of the present disclosure is not limited to the image forming apparatus 100 depicted in FIG. 1 that forms a color toner image. Alternatively, the image forming apparatus applied with the embodiments of the present disclosure may be a monochrome image forming apparatus that forms a monochrome toner image, a copier, a printer, a facsimile machine, a multifunction peripheral (MFP) having at least two of copying, printing, facsimile, scanning, and plotter functions, or the like.

Figure 26:
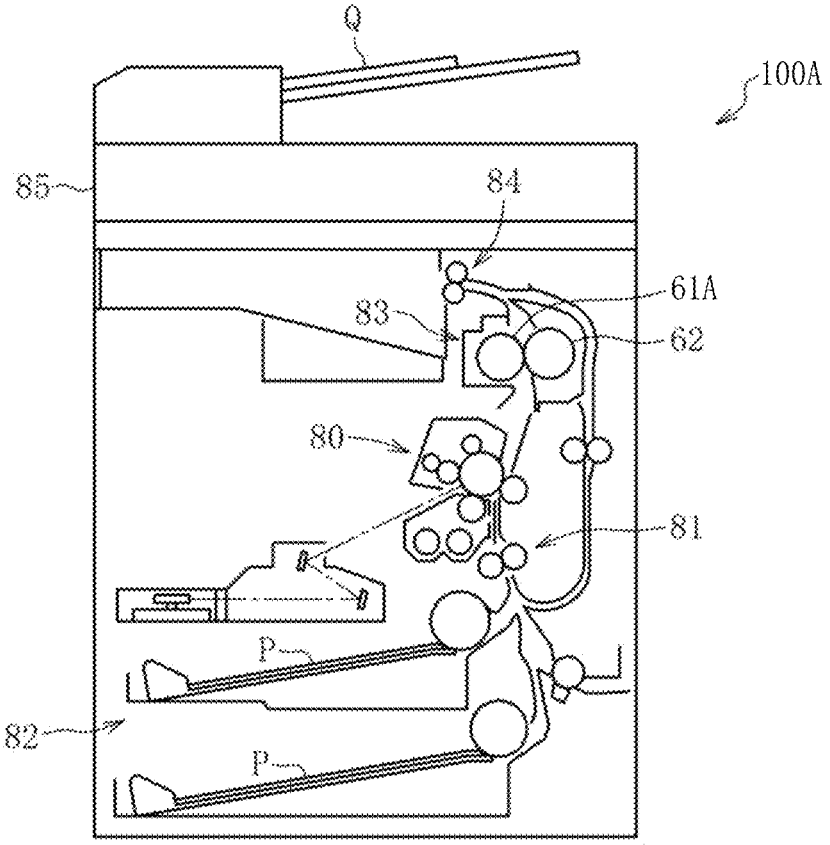
FIG. 26 is a schematic cross-sectional view of an image forming apparatus according to another embodiment of the present disclosure.

For example, the embodiments of the present disclosure are also applied to an image forming apparatus 100A having a construction described below with reference to FIG. 26. As illustrated in FIG. 26, the image forming apparatus 100A includes an image forming device 80 including a photoconductive drum, a sheet conveyance device including a timing roller pair 81, a sheet feeder 82, a fixing device 83, an output device 84, and a scanner 85. The sheet feeder 82 includes a plurality of sheet trays (e.g., paper trays) that loads a plurality of sheets P having different sizes, respectively.

The scanner 85 reads an image on an original Q into image data. The sheet feeder 82 loads the plurality of sheets P and feeds the sheets P to a conveyance path one by one. The timing roller pair 81 conveys the sheet P conveyed through the conveyance path to the image forming device 80.

The image forming device 80 forms a toner image on the sheet P. For example, the image forming device 80 includes the photoconductive drum, a charging roller, an exposure device, a developing device, a replenishing device, a transfer roller, a cleaner, and a discharger. The fixing device 83 fixes the toner image on the sheet P under heat and pressure. The sheet P bearing the fixed toner image is conveyed to the output device 84 by a conveyance roller and the like. The output device 84 ejects the sheet P onto an outside of the image forming apparatus 100A.

Figure 27:
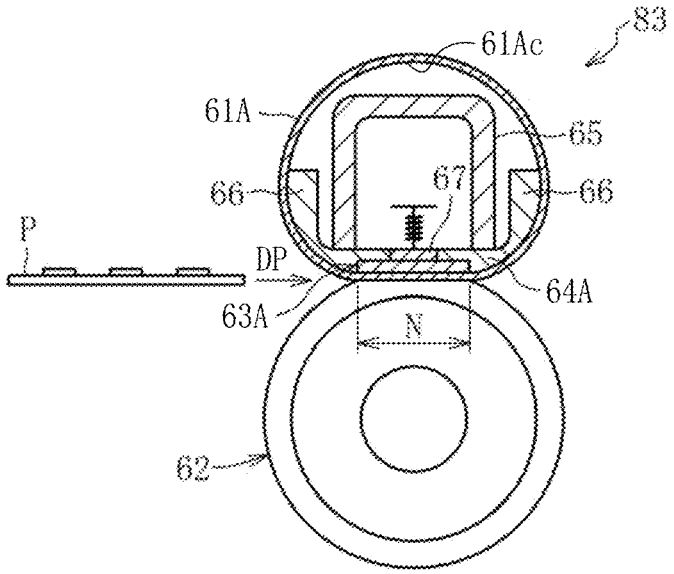
FIG. 27 is a schematic cross-sectional view of a fixing device incorporated in the image forming apparatus depicted in FIG. 26.

Referring to FIG. 27, a description is provided of a construction of the fixing device 83 according to an embodiment of the present disclosure.

The fixing device 83 depicted in FIG. 27 includes elements that are shared with the fixing device 60 depicted in FIG. 20 and assigned with reference numerals depicted in FIG. 20. A description of the shared elements is omitted.

As illustrated in FIG. 27, the fixing device 83 includes a fixing belt 61A, the pressure roller 62, a heater 63A, a heater holder 64A, the stay 65, and the temperature sensor 67.

The fixing nip N is formed between the fixing belt 61A and the pressure roller 62. The fixing nip N has a nip length of 10 mm in the sheet conveyance direction DP. The fixing belt 61A and the pressure roller 62 convey the sheet P at a linear velocity of 240 mm/s.

The fixing belt 61A includes the base layer made of polyimide and the release layer and does not include the elastic layer. The release layer is heat-resistant film made of fluororesin, for example. The fixing belt 61A has an outer diameter of approximately 24 mm.

The pressure roller 62 includes the core metal, the elastic layer, and the release layer. The pressure roller 62 has an outer diameter in a range of from 24 mm to 30 mm. The elastic layer of the pressure roller 62 has a thickness in a range of from 3 mm to 4 mm.

The heater 63A includes a base layer, a heat insulation layer, a conductor layer including a resistive heat generator, and an insulating layer. The heater 63A has a total thickness of 1 mm. The heater 63A has a length of 13 mm in the sheet conveyance direction DP.

Like in the embodiments described above, also in the construction depicted in FIG. 27, as the pressure roller 62 rotates, the pressure roller 62 drives and rotates the fixing belt 61A. Like in the fixing device 20 depicted in FIG. 7, the thrust force Fx generates at the meshing portion where the first gear 41 meshes with the second gear 42. The thrust force Fx presses the cap 29A, that is, one of the caps 29A and 29B (e.g., a left cap in FIG. 11), against the end face 21*a* of the fixing belt 21 equivalent to the fixing belt 61A in FIG. 27. The thrust force Fx presses the cap 29B, that is, another one of the caps 29A and 29B (e.g., the right cap in FIG. 11), against the side plate 30B disposed opposite the cap 29B. The fixing belt 21 is positioned in the right region 20*b* in FIG. 11 that is defined by the center C of the fixing belt 21 in the longitudinal direction X thereof, where the cap 29B is disposed.

Figure 28:
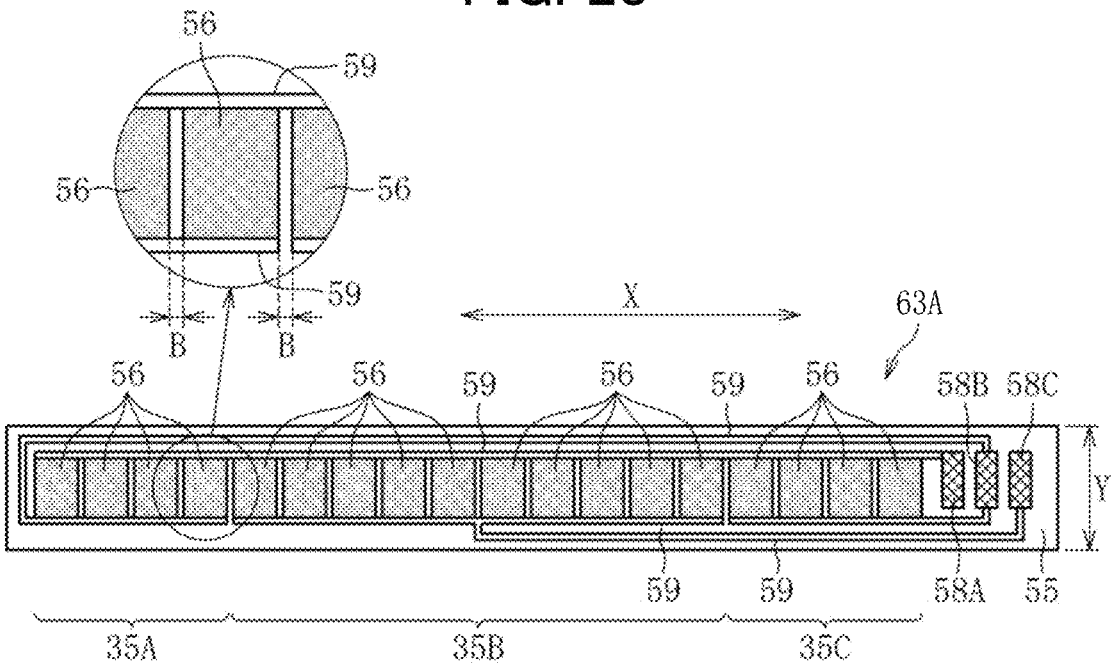
FIG. 28 is a plan view of a heater incorporated in the fixing device depicted in FIG. 27.

As illustrated in FIG. 28, the heater 63A includes a plurality of resistive heat generators 56 that constructs a center heat generation portion 35B and lateral end heat generation portions 35A and 35C that generate heat separately from the center heat generation portion 35B. For example, the heater 63A further includes three electrodes 58A, 58B, and 58C. As power is supplied to the electrode 58A on the left of the electrode 58B and the electrode 58B disposed at a center of the three electrodes 58A, 58B, and 58C in FIG. 28, the lateral end heat generation portions 35A and 35C generate heat. As power is supplied to the electrodes 58A and 58C that sandwich the electrode 58B, the center heat generation portion 35B generates heat. For example, in order to fix a toner image on a sheet P having a decreased size, the center heat generation portion 35B generates heat. In order to fix a toner image on a sheet P having an increased size, the lateral end heat generation portions 35A and 35C and the center heat generation portion 35B generate heat collectively, heating the fixing belt 61A according to a size of a sheet P.

Figure 29:
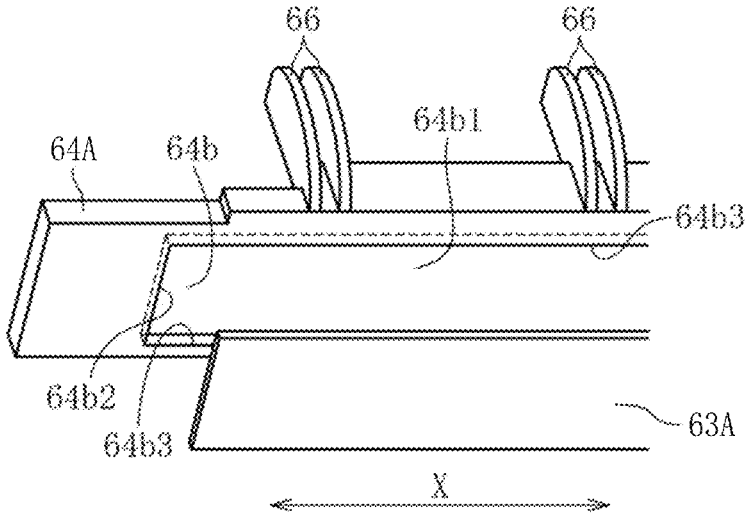
FIG. 29 is a perspective view of the heater and a heater holder incorporated in the fixing device depicted in FIG. 27.

As illustrated in FIG. 29, the heater holder 64A according to the embodiment includes a recess (4*b* that accommodates and holds the heater 63A. The recess 64*b* is disposed on a heater opposed face of the heater holder 64A, which is disposed opposite the heater 63A. The recess 64*b* is constructed of a bottom 64*b*1 (e.g., a bottom face) and four side walls 64*b*2 and 64*b*3 (e.g., side faces). The bottom 64*bi* is a rectangle that is equivalent to the heater 63A in size. The four side walls 64*b*2 and 64*b*3 extend along four sides, respectively, that define a contour of the bottom 64*b*1 and are perpendicular to the bottom 64*b*1. The pair of side walls 64*b*2 extends in a direction perpendicular to the longitudinal direction X of the heater 63A in which the resistive heat generators 56 are arranged. One of the side walls 64*b*2 may be omitted so that the recess 64*b* is open at one lateral end of the heater 63A in the longitudinal direction X thereof.

Figure 30:
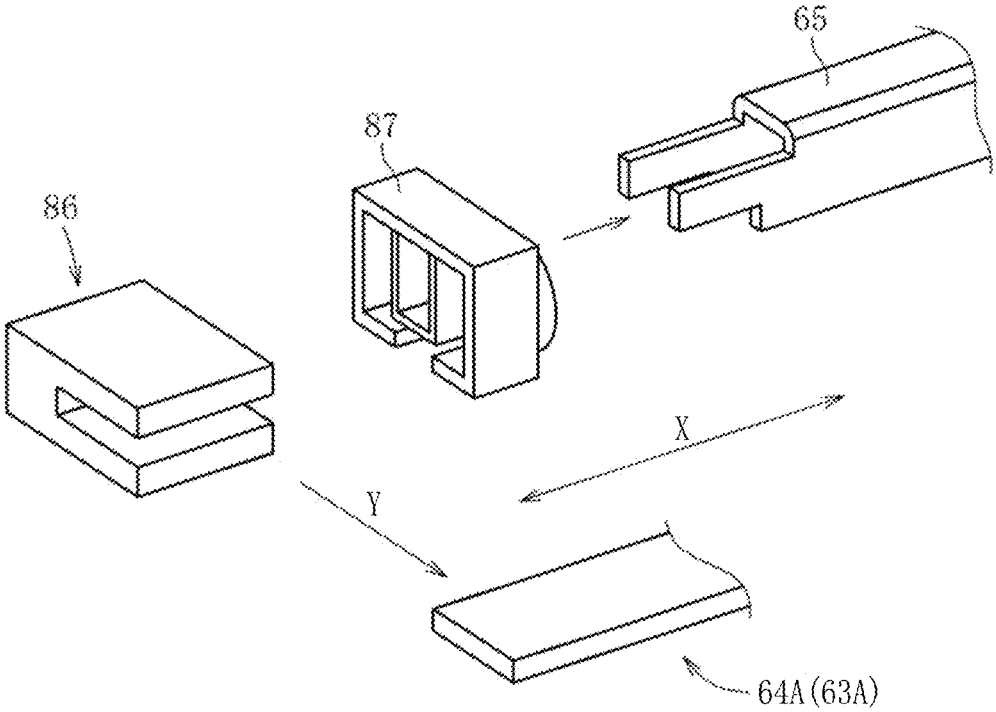
FIG. 30 is a perspective view of a connector to be attached to the heater depicted in FIG. 29, illustrating a method for attaching the connector to the heater.

As illustrated in FIG. 30, the heater 63A and the heater holder 64A according to the embodiment are held or supported by a connector 86. The connector 86 includes a housing made of resin such as LCP and a plurality of contact terminals disposed in the housing.

The connector 86 is attached to the heater 63A and the heater holder 64A in an orthogonal direction Y perpendicular to the longitudinal direction X of the heater 63A in which the resistive heat generators 56 are arranged. The connector 86 is attached to one lateral end of the heater 63A and the heater holder 64A in the longitudinal direction X of the heater 63A in which the resistive heat generators 56 are arranged. The one lateral end of the heater 63A and the heater holder 64A is opposite to another lateral end of the heater 63A and the heater holder 64A to which the driver (e.g., a motor) that drives the pressure roller 62 is coupled. Alternatively, in order to attach the connector 86 to the heater holder 64A, one of the connector 86 and the heater holder 64A may include a projection that engages a recess disposed in another one of the connector 86 and the heater holder 64A such that the projection moves inside the recess relatively.

In a state in which the connector 86 is attached to the heater 63A and the heater holder 64A, the connector 86 sandwiches and holds the heater 63A and the heater holder 64A such that the connector 86 is disposed opposite a front face and a back face of the heater 63A and the heater holder 64A. While the connector 86 sandwiches and holds the heater 63A and the heater holder 64A, as the contact terminals of the connector 86 contact and press against the electrodes 58A, 58B, and 58C of the heater 63A depicted in FIG. 28, the resistive heat generators 56 are electrically connected to a power supply disposed in the image forming apparatus 100A through the connector 86. Thus, the power supply is ready to supply power to the resistive heat generators 56.

The fixing device 83 further includes a flange 87 depicted in FIG. 30. The flange 87 is disposed on each lateral end of the fixing belt 61A in the longitudinal direction X thereof. The flange 87 serves as a belt holder that contacts an inner circumferential face 61Ac of the fixing belt 61A depicted in FIG. 27 and holds or supports the fixing belt 61A at each lateral end of the fixing belt 61A in the longitudinal direction X thereof. The flange 87 is inserted into each lateral end of the stay 65 in the longitudinal direction X thereof and is secured to each of a pair of side plates serving as a frame of the fixing device 83.

Figure 31:
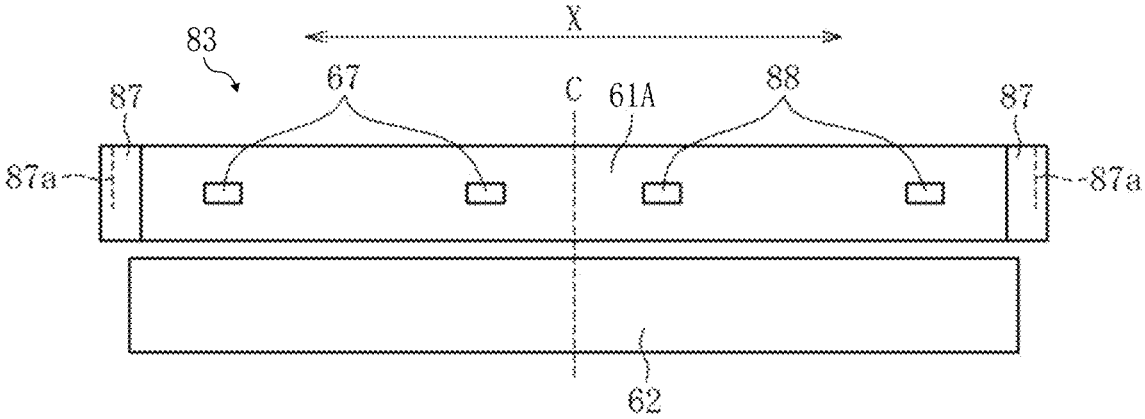
FIG. 31 is a diagram of the fixing device depicted in FIG. 27, illustrating an arrangement of temperature sensors and thermostats incorporated therein.

FIG. 31 is a diagram of the fixing device 83, illustrating an arrangement of the temperature sensors 67 and a plurality of thermostats 88 serving as a breaker according to the embodiment.

As illustrated in FIG. 31, the temperature sensors 67 according to the embodiment are disposed opposite the inner circumferential face 61Ac of the fixing belt 61A at a position in proximity to the center C and a position at one lateral end of the fixing belt 61A in the longitudinal direction X thereof, respectively. One of the temperature sensors 67 is disposed opposite a gap B depicted in FIG. 28 between the adjacent resistive heat generators 56 of the heater 63A.

The thermostats 88 serving as the breaker are disposed opposite the inner circumferential face 61Ac of the fixing belt 61A at a position in proximity to the center C and a position at another lateral end of the fixing belt 61A in the longitudinal direction X thereof, respectively. Each of the thermostats 88 detects a temperature of the inner circumferential face 61Ac of the fixing belt 61A or an ambient temperature at a position in proximity to the inner circumferential face 61Ac of the fixing belt 61A. If the temperature detected by the thermostat 88 is higher than a preset threshold, the thermostat 88 breaks power to the heater 63A.

Figure 32:
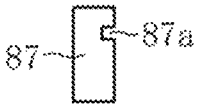
FIG. 32 is a diagram of a flange incorporated in the fixing device depicted in FIG. 27, illustrating a slide groove of the flange.

As illustrated in FIGS. 31 and 32, the flanges 87 that hold both lateral ends of the fixing belt 61A in the longitudinal direction X thereof include slide grooves 87*a*, respectively. The slide grooves 87*a* extend in a contact-separation direction in which the fixing belt 61A comes into contact with and separates from the pressure roller 62. The slide grooves 87*a* engage engagements mounted on the frame of the fixing device 83, respectively. As the engagements move relatively inside the slide grooves 87*a*, respectively, the fixing belt 61A moves in the contact-separation direction with respect to the pressure roller 62.

The above describes the constructions of the fixing devices 20A, 20B, 60, 60A, 608, 60C, 60D, and 83 and the image forming apparatus 100A to which the technology of the present disclosure applied to the fixing device 20 and the image forming apparatus 100 is also applied. The fixing devices 20A, 20B, 60, 60A, 60B, 60C, 60D, and 83 and the image forming apparatus 100A that are applied with the technology of the present disclosure achieve advantages similar to the advantages achieved by the fixing device 20 and the image forming apparatus 100 according to the embodiments of the present disclosure. For example, the fixing devices 20, 20A, 20B, 60, 60A, 60B, 60K, 60D, and 83 and the image forming apparatuses 100 and 100A that are applied with the technology of the present disclosure retain a proper contact state in which the end face contact member (e.g., the caps 29A and 29B) contacts the end face (e.g., the end faces 21*a* and 21*b*) of the fixing belt (e.g., the fixing belts 21, 61, and 61A and the belts 71 and 72), thus preventing the lubricant from entering the gap between the end face of the fixing belt and the end face contact member effectively.

The fixing devices (e.g., the fixing devices 20, 20A, 20B, 60, 60A, 60B, 60C, 60D, and 83) according to the embodiments of the present disclosure include the slide aid that contacts the inner circumferential face (e.g., the inner circumferential faces 21*c*, 61*c*, 61Ac, and 72*c*) of the fixing belt and is relatively slid by the fixing belt that rotates. The slide aid includes, in addition to the nip formation pad 24 or the slide sheet 28 depicted in FIG. 2, the heater 63 depicted in FIGS. 20 to 25, the nip formation pad 68 depicted in FIGS. 23 and 24, and the nip formation pad 74 depicted in FIG. 25.

The lubricant applied between the fixing belt and the slide aid may be grease or oil. Since viscosity of grease is greater than viscosity of oil, if grease is used as the lubricant, the lubricant does not enter the gap between the end face of the fixing belt and the end face contact member disposed opposite the end face of the fixing belt easily, thus suppressing slippage of the end face contact member over the fixing belt further. Conversely, if oil is used as the lubricant, the lubricant decreases friction between the fixing belt and the slide aid effectively, suppressing abrasion of the fixing belt.

Figure 33:
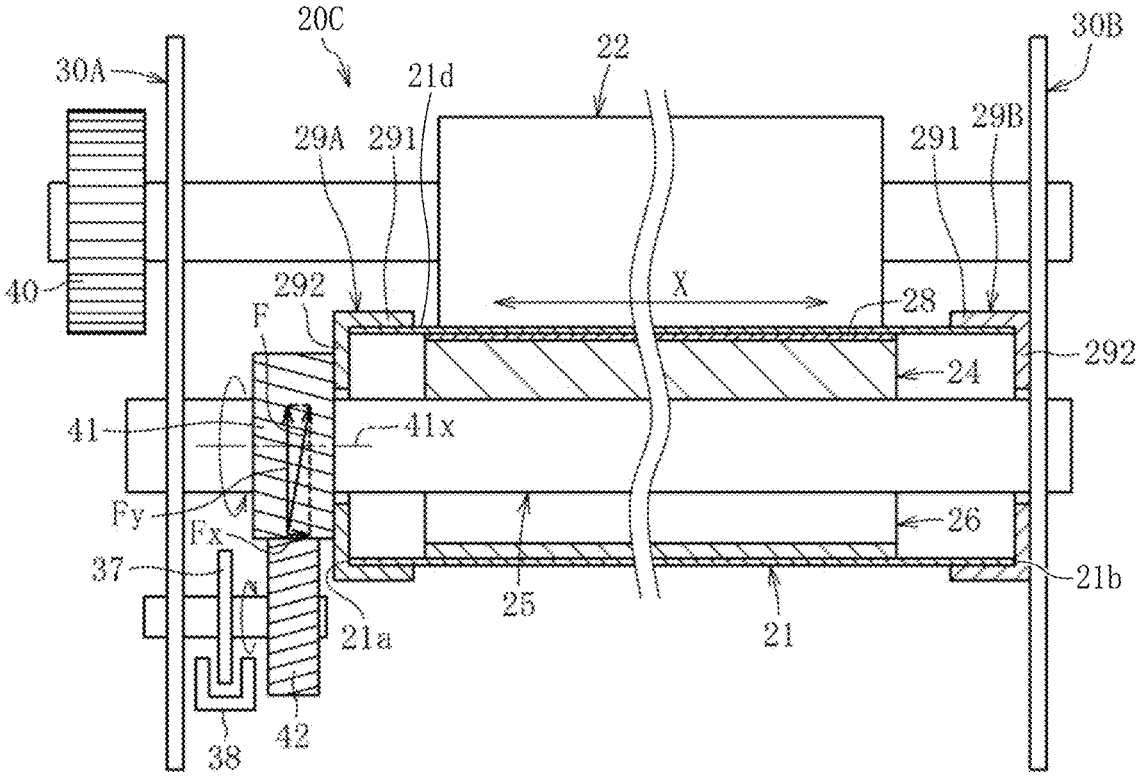
FIG. 33 is a diagram of a fixing device as yet another variation of the fixing device depicted in FIG. 2, which omits elastic layers interposed between caps and lateral ends of the fixing belt incorporated in the fixing device depicted in FIG. 2.

According to the embodiments described above, as illustrated in FIG. 5, the elastic layers 36A and 36B are interposed between the outer circumferential face 21*d* of the fixing belt 21 and inner circumferential faces of the caps 29A and 29B, respectively. Conversely, as illustrated in FIG. 33, the image forming apparatus 100 may incorporate a fixing device 20C according to an embodiment of the present disclosure that does not include the elastic layers 36A and 36B. For example, the caps 29A and 29B have an increased coefficient of friction and rotate in accordance with rotation of the fixing belt 21. Since the fixing device 20C does not incorporate the elastic layers 36A and 36B, each of the caps 29A and 29B has the inner circumferential face that contacts the outer circumferential face 21*d* of the fixing belt 21 directly.

The technology of the present disclosure is also applied to fixing devices 60E, 60F, and 60G illustrated in FIGS. 34, 40, and 45 that have constructions described below, respectively.

Figure 34:
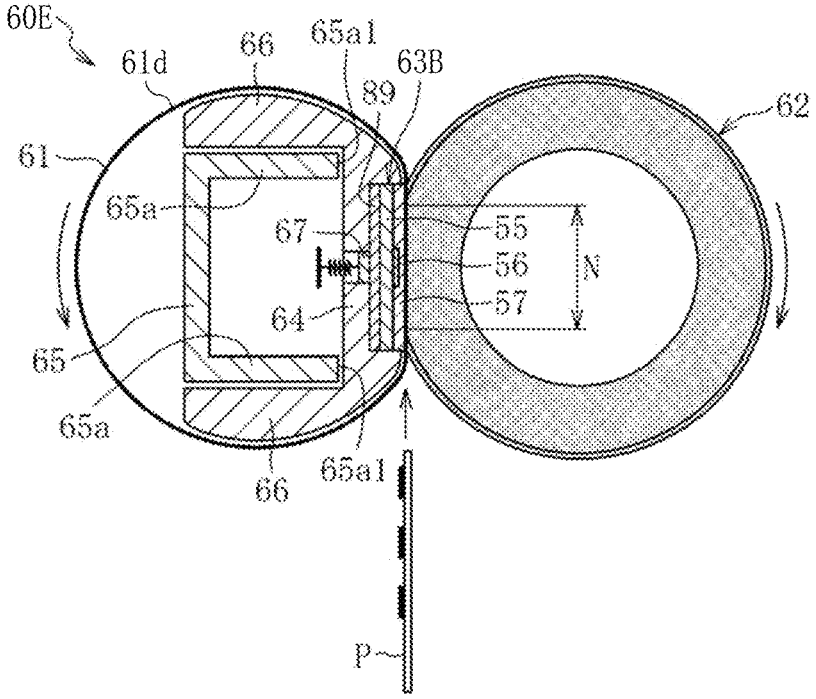
FIG. 34 is a schematic cross-sectional view of a fixing device according to yet another embodiment of the present disclosure that is installable in the image forming apparatus depicted in FIG. 1.

FIG. 34 is a schematic cross-sectional view of the fixing device 60E according to an embodiment of the present disclosure.

As illustrated in FIG. 34, the fixing device 60E according to the embodiment includes the fixing belt 61, the pressure roller 62, a heater 63B, the heater holder 64, the stay 65, the temperature sensor 67, and a first thermal conductor 89. The fixing belt 61 serves as a rotator, an endless rotator, or a fixing rotator. The pressure roller 62 serves as an opposed rotator or a pressure rotator. The stay 65 serves as a support. The temperature sensor 67 (e.g., a thermistor) serves as a temperature detector. The fixing belt 61 is an endless belt. The pressure roller 62 contacts an outer circumferential face 61*d* of the fixing belt 61 to form the fixing nip N between the fixing belt 61 and the pressure roller 62. The heater 63B heats the fixing belt 61. The heater holder 64 holds or supports the heater 63B. The stay 65 supports the heater holder 64. The temperature sensor 67 detects a temperature of the first thermal conductor 89. The fixing device 60E according to the embodiment has the construction basically similar to the construction of the fixing device 60 depicted in FIG. 20. However, the fixing device 60E incorporates the first thermal conductor 89. The fixing belt 61, the pressure roller 62, the heater 63B, the heater holder 64, the stay 65, and the first thermal conductor 89 extend in a longitudinal direction that is perpendicular to a paper surface in FIG. 34 and is parallel to the width direction of a sheet P conveyed through the fixing nip N, a belt width direction of the fixing belt 61, and the axial direction of the pressure roller 62.

Like the heater 63A depicted in FIG. 28, the heater 63B according to the embodiment includes a plurality of resistive heat generators 56 arranged on the base 55 in the longitudinal direction of the heater 63B with the gap between the adjacent resistive heat generators 56. However, with the construction in which the plurality of resistive heat generators 56 is arranged with the gap between the adjacent resistive heat generators 56, the heater 63B has a gap region disposed opposite the gap and a heat generator region disposed opposite the resistive heat generator 56. The gap region is subject to a decreased temperature that is lower than an increased temperature of the heat generator region. Accordingly, the fixing belt 61 has a gap region disposed opposite the gap region of the heater 63B. The gap region of the fixing belt 61 also has a decreased temperature, resulting in uneven temperature of the fixing belt 61 in the longitudinal direction X thereof.

To address this circumstance, the fixing device 60E according to the embodiment includes the first thermal conductor 89 that suppresses temperature decrease in the gap region of the fixing belt 61 and therefore suppresses uneven temperature of the fixing belt 61 in the longitudinal direction X thereof.

A description is provided of a construction of the first thermal conductor 89 in detail.

As illustrated in FIG. 34, the first thermal conductor 89 is interposed between the heater 63B and the stay 65 in a horizontal direction in FIG. 34. Specifically, the first thermal conductor 89 is sandwiched between the heater 638 and the heater holder 64. For example, the first thermal conductor 89 has one face that contacts a back face of the base 55 of the heater 63B. The first thermal conductor 89 has another face (e.g., an opposite face opposite to the one face) that contacts the heater holder 64.

The stay 65 includes two perpendicular portions 65*a* that extend in a thickness direction of the heater 63B and the like. Each of the perpendicular portions 65*a* has a contact face 65*a*1 that contacts the heater holder 64, supporting the heater holder 64, the first thermal conductor 89, and the heater 63B. The contact faces 65*a*1 are disposed outboard from the resistive heat generators 56 in the orthogonal direction Y perpendicular to the longitudinal direction X of the stay 65 (e.g., a vertical direction in FIG. 34). Thus, the stay 65 suppresses conduction of heat thereto from the heater 63B, causing the heater 63B to heat the fixing belt 61 efficiently.

Figure 35:
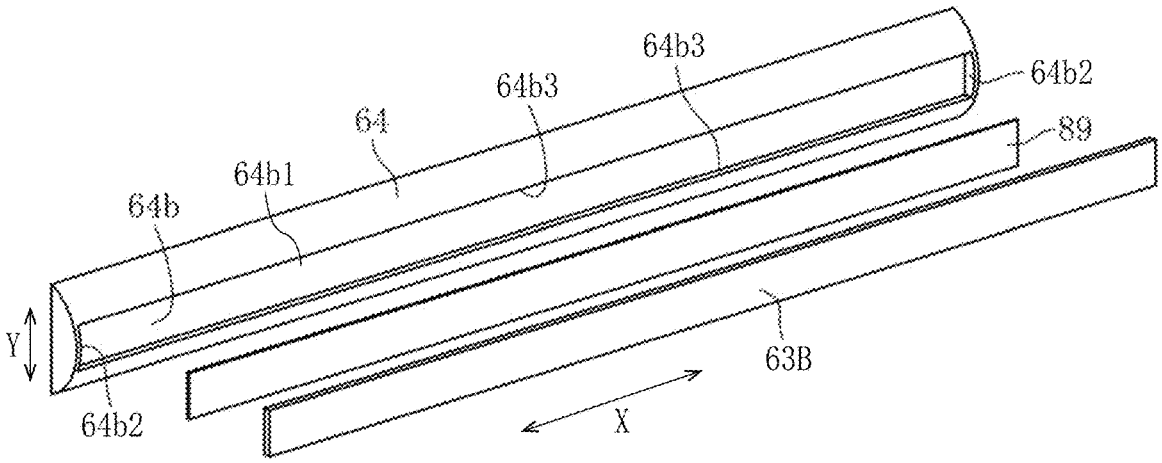
FIG. 35 is a perspective view of a heater, a first thermal conductor, and a heater holder incorporated in the fixing device depicted in FIG. 34.

As illustrated in FIG. 35, the first thermal conductor 89 is a plate having an even thickness. For example, the first thermal conductor 89 has a thickness of 0.3 mm, a length of 222 mm in the longitudinal direction X thereof, and a width of 10 mm in the orthogonal direction Y perpendicular to the longitudinal direction X thereof. According to the embodiment, the first thermal conductor 89 is made of a single plate. Alternatively, the first thermal conductor 89 may be made of a plurality of members. FIG. 35 omits illustration of the guides 66 depicted in FIG. 34.

The first thermal conductor 89 is fitted to the recess 64*b* of the heater holder 64. The heater 63B is attached to the heater holder 64 from above the first thermal conductor 89. Thus, the heater holder 64 and the heater 63B sandwich and hold the first thermal conductor 89. According to the embodiment, the first thermal conductor 89 has a length in the longitudinal direction X thereof, which is equivalent to a length of the heater 63B in the longitudinal direction X thereof. The recess 64*b* is constructed of the bottom 64*b*1 and the side walls 64*b*2 and 64*b*3 that are perpendicular to the bottom 64*b*1. The side walls 64*b*2 serving as a longitudinal direction restrictor extend in the orthogonal direction Y perpendicular to the longitudinal direction X of the heater holder 64. The side walls 64*b*2 restrict motion of the first thermal conductor 89 and the heater 63B in the longitudinal direction X thereof. Thus, the side walls 64*b*2 restrict shifting of the first thermal conductor 89 in the longitudinal direction X thereof inside the fixing device 60E, improving efficiency in conduction of heat in a target span in the longitudinal direction X of the first thermal conductor 89. The side walls 64*b*3 of the recess 64*b* serve as an orthogonal direction restrictor and extend in the longitudinal direction X of the recess 64*b* of the heater holder 64. The side walls 64*b*3 restrict motion of the first thermal conductor 89 and the heater 63B in the orthogonal direction Y perpendicular to the longitudinal direction X thereof.

Figure 36:
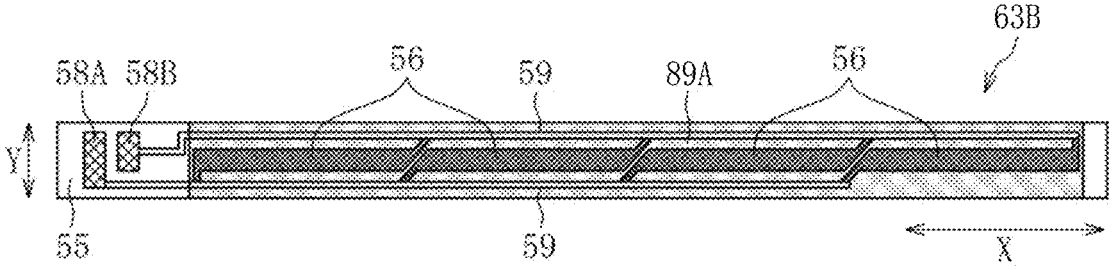
FIG. 36 is a plan view of the heater depicted in FIG. 35, illustrating an arrangement of a first thermal conductor as a variation of the first thermal conductor depicted in FIG. 35.
Figure 37:
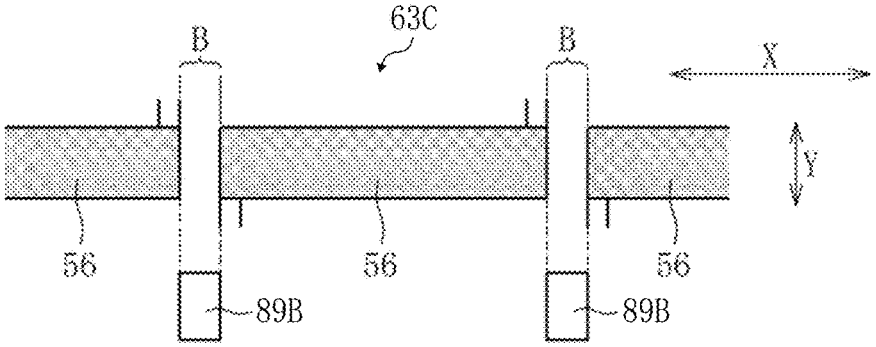
FIG. 37 is a plan view of a heater and first thermal conductors as another variation of the heater and the first thermal conductor depicted in FIG. 35, illustrating another arrangement of the first thermal conductors.

The first thermal conductor 89 may extend in a span other than a span in which the thermal conductor 89 extends in the longitudinal direction X thereof as illustrated in FIG. 35. For example, as illustrated in FIG. 36, the fixing device 60E may employ a first thermal conductor 89A that extends in a span hatched in FIG. 36 in which the resistive heat generators 56 are arranged in the longitudinal direction X of the heater 63B. As illustrated in FIG. 37, the fixing device 60E may include a heater 63C and first thermal conductors 89B that are disposed opposite and span the gaps B, respectively, in the longitudinal direction X of the heater 63C. FIG. 37 illustrates the resistive heat generators 56 shifted from the first thermal conductors 89B vertically in FIG. 37 for convenience. Practically, the resistive heat generators 56 are substantially leveled with the first thermal conductors 89B in the orthogonal direction Y perpendicular to the longitudinal direction X. The first thermal conductor 898 may span a part of the resistive heat generator 56 in the orthogonal direction Y.

Figure 38:
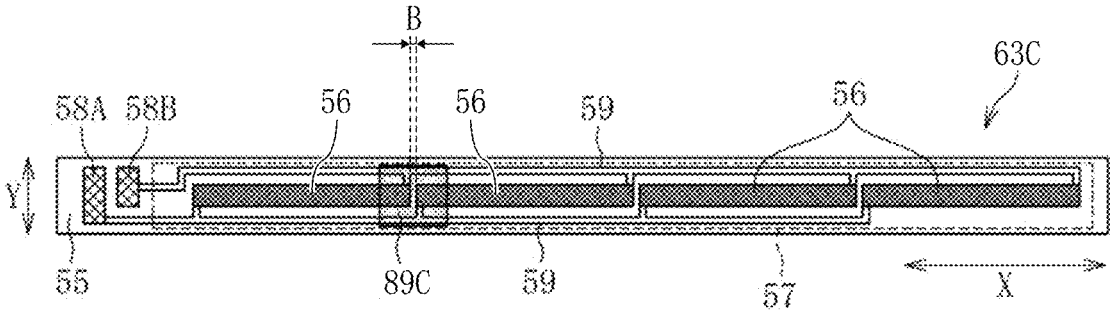
FIG. 38 is a plan view of the heater depicted in FIG. 37 and a first thermal conductor as yet another variation of the first thermal conductor depicted in FIG. 35, illustrating yet another arrangement of the first thermal conductor.

As illustrated in FIG. 38, the fixing device 60E may employ a first thermal conductor 89C that spans an entirety of the resistive heat generator 56 in the orthogonal direction Y. As illustrated in FIG. 38, the first thermal conductor 89C is disposed opposite and spans the gap B in the longitudinal direction X of the heater 63C. Additionally, the first thermal conductor 89C bridges the adjacent resistive heat generators 56 that sandwich the gap B. A state in which the first thermal conductor 89C bridges the adjacent resistive heat generators 56 denotes a state in which the first thermal conductor 89C overlaps the adjacent resistive heat generators 56 at least partially in the longitudinal direction X of the heater 63C. The fixing device 60E may incorporate a plurality of first thermal conductors 89C that is disposed opposite a plurality of gaps B of the heater 63C, respectively. As illustrated in FIG. 38, the fixing device 60E may employ one or more first thermal conductors 89C that are disposed opposite a part of the plurality of gaps B (e.g., a single gap B according to an embodiment depicted in FIG. 38). A state in which the first thermal conductor 89C is disposed opposite the gap B denotes a state in which at least a part of the first thermal conductor 89C overlaps the gap B in the longitudinal direction X of the first thermal conductor 89C.

As the pressure roller 62 applies pressure to a heater (e.g., the heaters 63B and 63C), the heater and the heater holder 64 sandwich a first thermal conductor (e.g., the first thermal conductors 89, 89A, 89B, and 89C) such that the first thermal conductor contacts the heater and the heater holder 64. As the first thermal conductor contacts the heater, the first thermal conductor conducts heat generated by the heater in the longitudinal direction X thereof with improved efficiency. The first thermal conductors are disposed opposite the gaps B arranged in the longitudinal direction X of the heater, respectively. Thus, the first thermal conductors improve efficiency in conduction of heat at the gaps B, increase an amount of heat conducted to the gaps B, and increase the temperature of the heater at the gaps B. Accordingly, the first thermal conductors suppress uneven temperature of the heater in the longitudinal direction X thereof, thereby suppressing uneven temperature of the fixing belt 61 in the longitudinal direction X thereof. Consequently, the fixing belt 61 suppresses uneven fixing and uneven gloss of a toner image fixed on a sheet P. The heater does not increase an amount of heat generation to attain sufficient fixing performance at the gaps B, causing the fixing device 60E to save energy. For example, if the first thermal conductor (e.g., the first thermal conductors 89 and 89A depicted in FIGS. 35 and 36, respectively) spans an entire region where the resistive heat generators 56 are arranged in the longitudinal direction X, the first thermal conductor improves efficiency in conduction of heat of the heater (e.g., the heater 63B depicted in FIGS. 35 and 36) in an entirety of a main heating span of the heater disposed opposite an imaging span of a toner image formed on a sheet P conveyed through the fixing nip N. Accordingly, the first thermal conductor suppresses uneven temperature of the heater and the fixing belt 61 in the longitudinal direction X thereof.

The first thermal conductor (e.g., the first thermal conductors 89, 89A, 89B, and 89C) is coupled to the resistive heat generator 56 having a positive temperature coefficient (PTC) property, suppressing overheating of the fixing belt 61 in a non-conveyance span where a sheet P having a decreased size is not conveyed more effectively. The PTC property defines a property in which the resistance value increases as the temperature increases, for example, a heater output decreases under a given voltage. For example, the resistive heat generator 56 having the PTC property suppresses an amount of heat generation in the non-conveyance span effectively. Additionally, the first thermal conductor conducts heat from the non-conveyance span on the fixing belt 61 that suffers from temperature increase to a conveyance span on the fixing belt 61 efficiently. The PTC property and heat conduction of the resistive heat generator 56 attain a synergistic effect that suppresses overheating of the fixing belt 61 in the non-conveyance span effectively.

Figure 39:
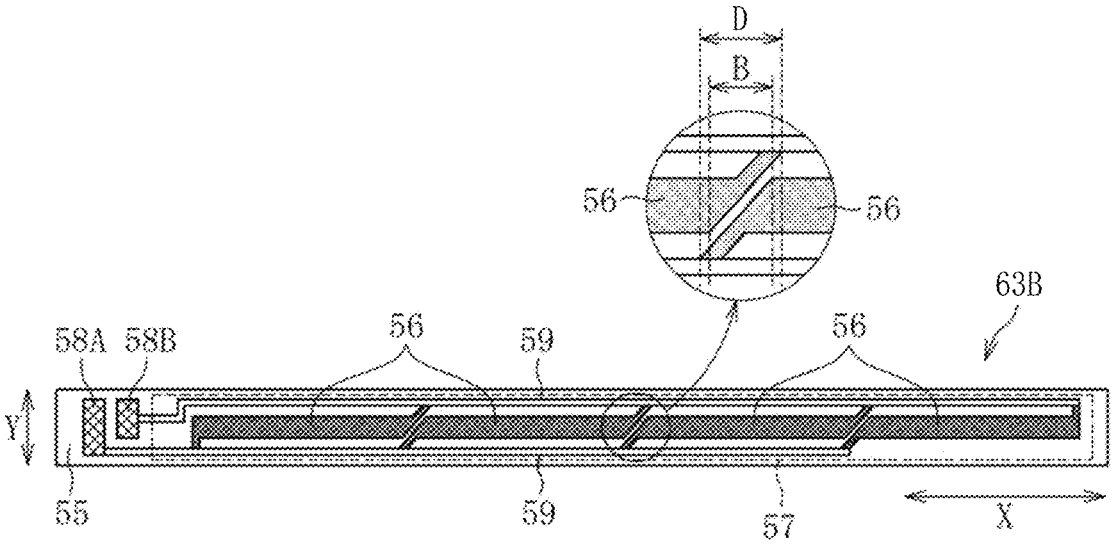
FIG. 39 is a plan view of the heater depicted in FIG. 36, illustrating a partially enlarged view thereof.

Since the heater (e.g., the heaters 63B and 63C) generates heat in a decreased amount at the gap B, the heater has a decreased temperature also in a periphery of the gap B. To address this circumstance, the first thermal conductor is preferably disposed in the periphery of the gap B. For example, as illustrated in FIG. 39, the first thermal conductor is disposed opposite an enlarged gap region D encompassing the periphery of the gap B. Thus, the first thermal conductor improves efficiency in conduction of heat in the longitudinal direction X of the heater at the gap B and the periphery thereof, suppressing uneven temperature of the heater in the longitudinal direction X thereof more effectively. If the first thermal conductor (e.g., the first thermal conductors 89 and 89A depicted in FIGS. 35 and 36, respectively) spans the entire region where the resistive heat generators 56 are arranged in the longitudinal direction X thereof, the first thermal conductor suppresses uneven temperature of the heater and the fixing belt 61 in the longitudinal direction X thereof more precisely.

A description is provided of the construction of the fixing device 60F according to an embodiment of the present disclosure.

Figure 40:
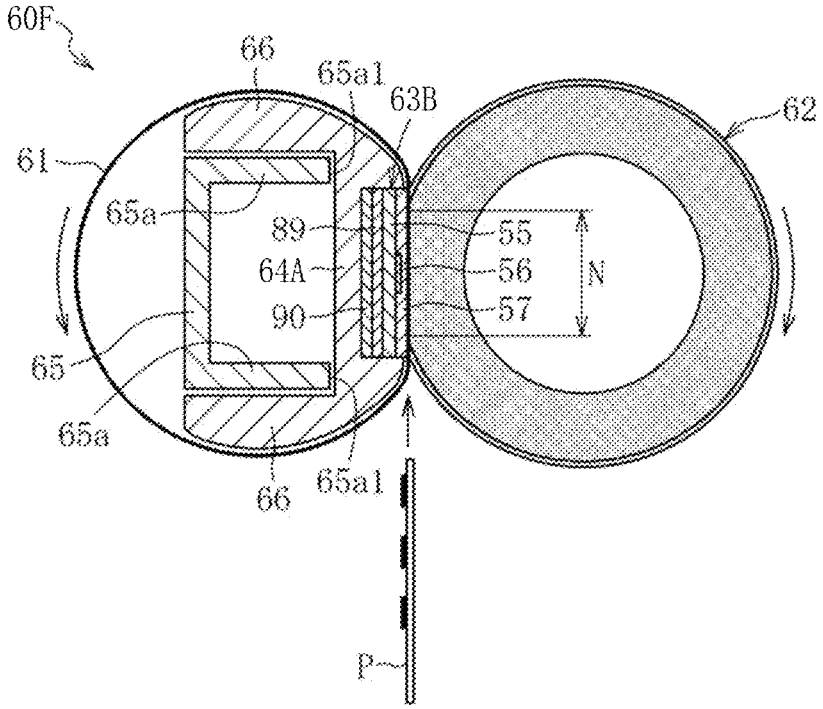
FIG. 40 is a schematic cross-sectional view of a fixing device according to yet another embodiment of the present disclosure that is installable in the image forming apparatus depicted in FIG. 1.

As illustrated in FIG. 40, the fixing device 60F includes a second thermal conductor 90 interposed between a heater holder 64A and the first thermal conductor 89. The second thermal conductor 90 is disposed at a position different from a position of the first thermal conductor 89 in a laminating direction (e.g., a horizontal direction in FIG. 40) in which the stay 65, the heater holder 64A, the second thermal conductor 90, the first thermal conductor 89, and the heater 63B are arranged. Specifically, the second thermal conductor 90 is superimposed on the first thermal conductor 89. Like the fixing device 60E depicted in FIG. 34, the fixing device 60F depicted in FIG. 40 incorporates the temperature sensor 67 (e.g., the thermistor). FIG. 40 illustrates a cross section of the fixing device 60F in which the temperature sensor 67 is not disposed.

The second thermal conductor 90 is made of a material having a thermal conductivity greater than a thermal conductivity of the base 55. For example, the second thermal conductor 90 is made of graphene or graphite. According to the embodiment, the second thermal conductor 90 is a graphite sheet having a thickness of 1 mm. Alternatively, the second thermal conductor 90 may be a plate made of aluminum, copper, silver, or the like.

Figure 41:
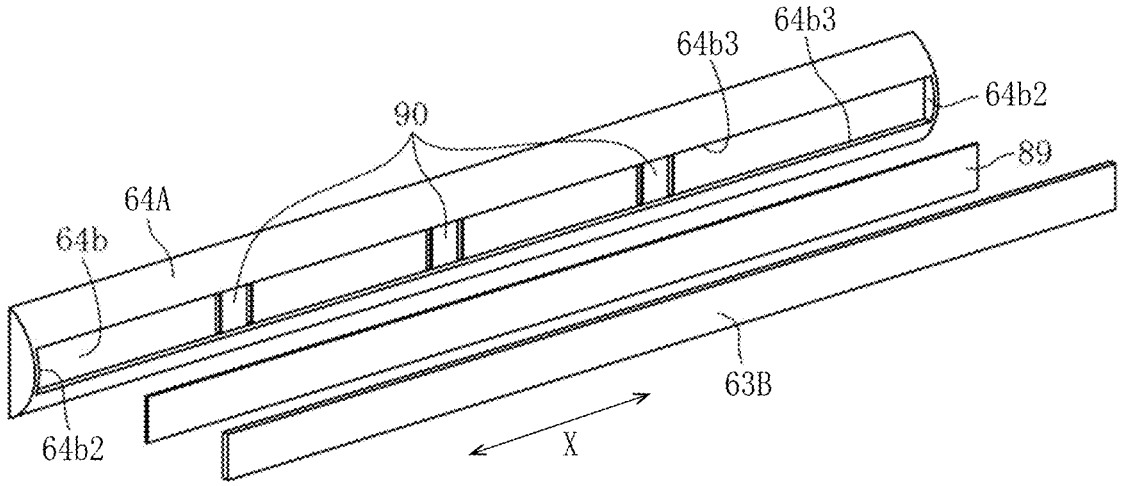
FIG. 41 is a perspective view of the heater, the first thermal conductor, second thermal conductors, and a heater holder incorporated in the fixing device depicted in FIG. 40.

As illustrated in FIG. 41, the fixing device 60F includes a plurality of second thermal conductors 90 that is placed in the recess 64*b* of the heater holder 64A. The adjacent second thermal conductors 90 sandwich a gap in the longitudinal direction X of the heater holder 64A. The heater holder 64A includes cavities placed with the second thermal conductors 90, respectively. The cavities are stepped down by one step from other portion of the heater holder 64A. The second thermal conductor 90 and the heater holder 64A define clearances therebetween at both lateral ends of the second thermal conductor 90 in the longitudinal direction X of the heater holder 64A. The clearances suppress conduction of heat from the second thermal conductor 90 to the heater holder 64A, causing the heater 63B to heat the fixing belt 61 efficiently. FIG. 41 omits illustration of the guides 66 depicted in FIG. 40.

Figure 42:
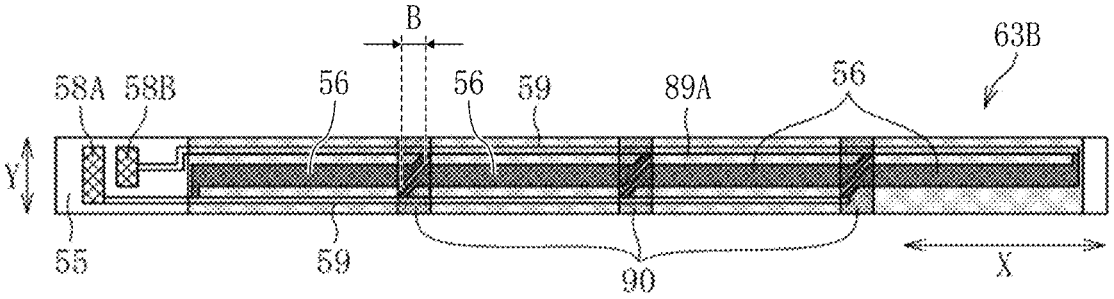
FIG. 42 is a plan view of the heater, the second thermal conductors depicted in FIG. 41, and the first thermal conductor depicted in FIG. 36, illustrating an arrangement of the first thermal conductor and the second thermal conductors.
Figure 44:
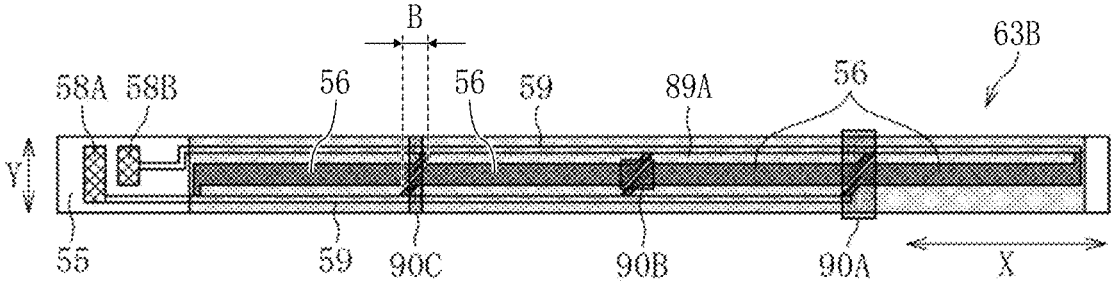
FIG. 44 is a plan view of the heater depicted in FIG. 42 and second thermal conductors as a variation of the second thermal conductors depicted in FIG. 41, illustrating yet another arrangement of the second thermal conductors.

As illustrated in FIG. 42, the second thermal conductor 90 that is hatched is disposed opposite the gap B between the adjacent resistive heat generators 56 and overlaps at least a part of the adjacent resistive heat generators 56 in the longitudinal direction X thereof. According to the embodiment, the second thermal conductor 90 spans an entirety of the gap B. FIG. 42 and FIG. 44 that is referred to in a description below illustrate the first thermal conductor 89A that spans the entire region where the resistive heat generators 56 are arranged in the longitudinal direction X thereof. Alternatively, the first thermal conductor 89A may span a region that is different from the region depicted in FIGS. 42 and 44.

The fixing device 60F according to the embodiment incorporates the second thermal conductor 90 in addition to the first thermal conductor 89 or 89A. The second thermal conductor 90 is disposed opposite the gap B and overlaps at least a part of the adjacent resistive heat generators 56 in the longitudinal direction X thereof. The second thermal conductor 90 further improves efficiency in conduction of heat at the gap B in the longitudinal direction X of the heater 63B, suppressing uneven temperature of the heater 63B in the longitudinal direction X thereof more effectively.

Figure 43:
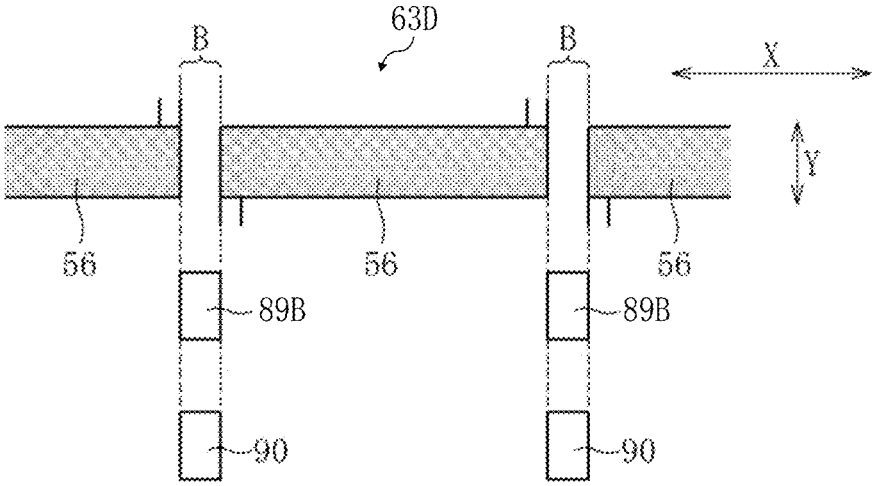
FIG. 43 is a plan view of the second thermal conductors depicted in FIG. 42 and the first thermal conductors depicted in FIG. 37, illustrating another arrangement of the first thermal conductors and the second thermal conductors.

As illustrated in FIG. 43, the fixing device 60F may include a heater 63D including the first thermal conductor 89B and the second thermal conductor 90 that are preferably disposed opposite an entire span of the gap B in the longitudinal direction X of the heater 63D. Accordingly, the first thermal conductor 89B and the second thermal conductor 90 improve efficiency in conduction of heat at the gap B compared to an outboard region of the heater 63D, which is other than the gap B. FIG. 43 illustrates the resistive heat generators 56 shifted from the first thermal conductors 89B and the second thermal conductors 90 vertically in FIG. 43 for convenience. Practically, the resistive heat generators 56 are substantially leveled with the first thermal conductors 89B and the second thermal conductors 90 in the orthogonal direction Y perpendicular to the longitudinal direction X. Alternatively, the first thermal conductors 89B and the second thermal conductors 90 may be disposed with respect to the resistive heat generators 56 with other arrangement. For example, the first thermal conductor 89B and the second thermal conductor 90 may span or cover a pan or the entirety of the resistive heat generator 56 in the orthogonal direction Y.

Each of the first thermal conductors 89, 89A, 89B, and 89C and the second thermal conductor 90 may be the graphene sheet. In this case, each of the first thermal conductors 89, 89A, 89B, and 89C and the second thermal conductor 90 has an enhanced thermal conductivity in a predetermined direction along a surface of the graphene sheet, that is, the longitudinal direction X, not a thickness direction of the graphene sheet. Accordingly, each of the first thermal conductors 89, 89A, 89B, and 89C and the second thermal conductor 90 suppresses uneven temperature of the heaters 63B, 63C, and 63D and the fixing belt 61 in the longitudinal direction X thereof effectively. Each of the first thermal conductors 89, 89A, 89B, and 89C and the second thermal conductor 90 may be a graphite sheet. A description of a configuration of each of the graphene sheet and the graphite sheet is provided below with reference to FIGS. 46 and 47.

The second thermal conductor 90 is disposed opposite and spans the gap B or the enlarged gap region D in the longitudinal direction X of the resistive heat generator 56. The second thermal conductor 90 overlaps at least a part of the adjacent resistive heat generators 56. Hence, the second thermal conductor 90 may be disposed with an arrangement different from an arrangement of the second thermal conductor 90 depicted in FIG. 42. For example, as illustrated in FIG. 44, the fixing device 60F may include second thermal conductors 90A, 90B, and 90C. The second thermal conductor 90A protrudes beyond the base 55 bidirectionally in the orthogonal direction Y. The second thermal conductor 90B is disposed within a span of the resistive heat generator 56 in the orthogonal direction Y. The second thermal conductor 90C spans a part of the gap B.

A description is provided of the construction of the fixing device 60G according to an embodiment of the present disclosure.

Figure 45:
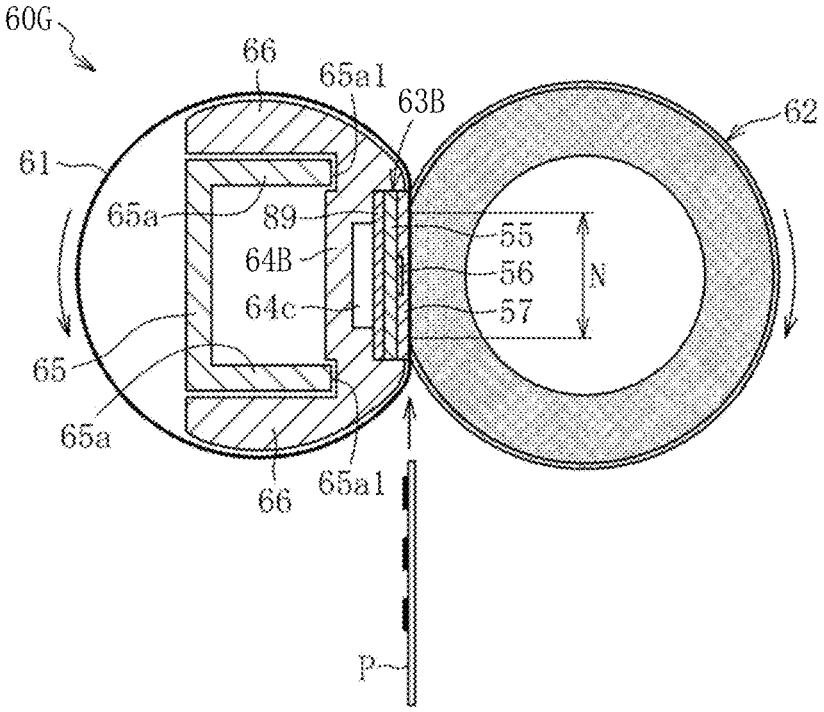
FIG. 45 is a schematic cross-sectional view of a fixing device according to yet another embodiment of the present disclosure that is installable in the image forming apparatus depicted in FIG. 1.

As illustrated in FIG. 45, the fixing device 60G includes a heater holder 64B. The heater holder 64B and the first thermal conductor 89 define a clearance therebetween in a thickness direction of the heater holder 64B (e.g., a horizontal direction in FIG. 45). For example, the heater holder 64B includes the recess 64*b* depicted in FIG. 41 that accommodates the heater 63B, the first thermal conductor 89, and the second thermal conductors 90. The heater holder 64B includes a retracted portion 64*c* serving as a heat insulation layer disposed at a pan of the recess 64*b*. The retracted portion 64*c* is disposed at a part of the recess 64*b*, which is outboard from a portion of the recess 64*b*, which is placed with the second thermal conductor 90, in the longitudinal direction X of the heater holder 64B. FIG. 45 omits illustration of the second thermal conductor 90. Apart of the recess 64*b* of the heater holder 64B is deepened compared to other pan of the recess 64*b* to produce the retracted portion 64*c*. Accordingly, the heater holder 64B contacts the first thermal conductor 89 with a minimum area, suppressing conduction of heat from the first thermal conductor 89 to the heater holder 64B and causing the heater 63B to heat the fixing belt 61 efficiently. On a cross section that crosses the longitudinal direction X of the fixing device 60G and is provided with the second thermal conductor 90, like in the fixing device 60F depicted in FIG. 40, the second thermal conductor 90 contacts the heater holder 64B.

The fixing device 60G according to the embodiment depicted in FIG. 45 includes the retracted portion 64*c* that spans the entirety of the resistive heat generator 56 in the orthogonal direction Y (e.g., a vertical direction in FIG. 45). Accordingly, the retracted portion 64*c* suppresses conduction of heat from the first thermal conductor 89 to the heater holder 64B effectively, improving efficiency in heating of the fixing belt 61 by the heater 63B. Alternatively, instead of the retracted portion 64*c* that defines the clearance, the fixing device 60G may incorporate a thermal insulator that has a thermal conductivity smaller than a thermal conductivity of the heater holder 64B as the heat insulation layer.

The fixing device 60G according to the embodiment includes the second thermal conductor 90 that is provided separately from the first thermal conductor 89. Alternatively, the fixing device 60G may have other configuration. For example, the first thermal conductor 89 may include an opposed portion that is disposed opposite the gap B and has a thickness greater than a thickness of an outboard portion of the first thermal conductor 89, which is other than the opposed portion. Thus, the first thermal conductor 89 also achieves a function of the second thermal conductor 90.

Figure 46:
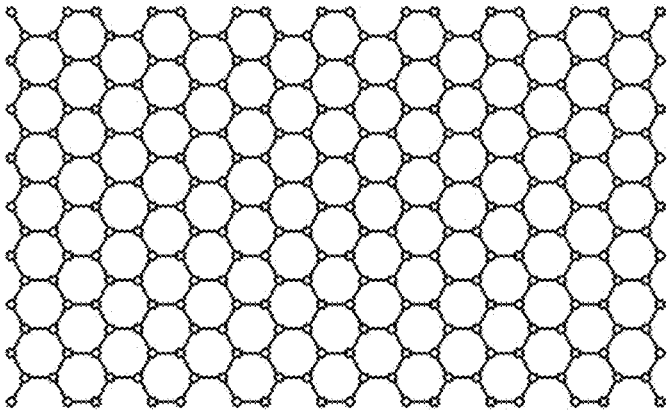
FIG. 46 is a diagram of a crystalline structure of atoms of graphene.
Figure 47:
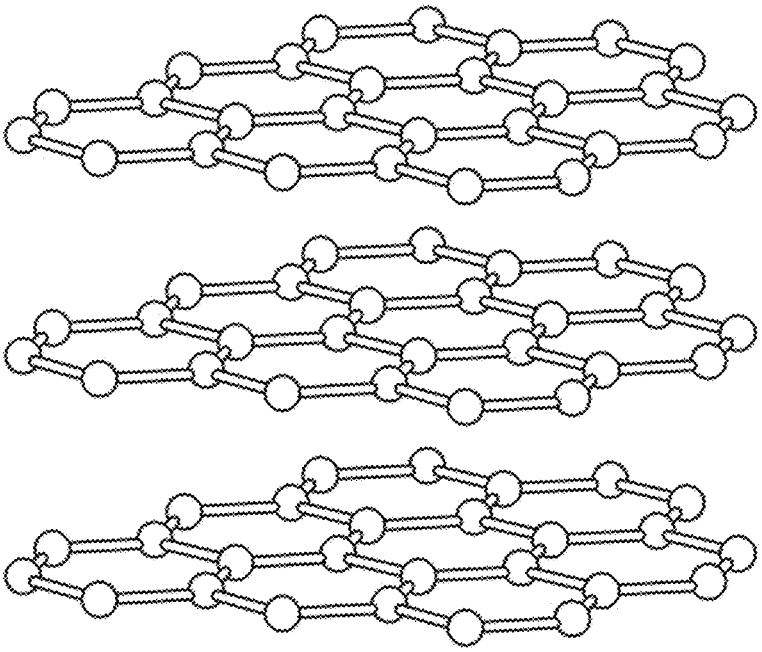
FIG. 47 is a diagram of a crystalline structure of atoms of graphite.

With reference to FIGS. 46 and 47, a description is provided of the configuration of each of the graphene sheet and the graphite sheet.

Graphene is thin powder. As illustrated in FIG. 46, graphene is constructed of a plane of carbon atoms arranged in a two-dimensional honeycomb lattice. The graphene sheet is graphene in a sheet form and is usually constructed of a single layer. The graphene sheet may contain impurities in the single layer of carbon atoms or may have a fullerene structure. The fullerene structure is generally recognized as a polycyclic compound constructed of an identical number of carbon atoms bonded to form a cage with fused rings of five and six atoms. For example, the fullerene structure is other closed cage structure formed of fullerene C60, C70, and C80 or 3-coordinated carbon atoms.

The graphene sheet is artificial and is produced by chemical vapor deposition (CVD), for example.

The graphene sheet is commercially available. A size and a thickness of the graphene sheet and a number of layers and the like of the graphite sheet described below are measured with a transmission electron microscope (TEM), for example.

Graphite is constructed of stacked layers of graphene and is highly anisotropic in thermal conduction. As illustrated in FIG. 47, graphite has a plurality of layers, each of which is constructed of hexagonal fused rings of carbon atoms, which are bonded planarly. The plurality of layers defines a crystalline structure. In the crystalline structure, adjacent carbon atoms in the layer are bonded with each other by a covalent bond. Bonding between the layers of carbon atoms achieves the van der Waals bond. The covalent bond achieves bonding greater than bonding of the van der Waals bond. Graphite is highly anisotropic with bonding within the layer and bonding between the layers. For example, the first thermal conductor (e.g., the first thermal conductors 89, 89A, 89B, and 89C) or the second thermal conductor (e.g., the second thermal conductors 90, 90A, 90B, and 90C) is made of graphite. Accordingly, the first thermal conductor or the second thermal conductor attains an efficiency in conduction of beat in the longitudinal direction X thereof, which is greater than an efficiency in conduction of heat in a thickness direction, that is, the laminating direction (e.g., the horizontal direction in FIG. 40) in which the stay 65, the heater holder 64A, the second thermal conductor 90, the first thermal conductor 89, and the heater 63B are arranged, thus suppressing conduction of heat to the heater holder 64A. Consequently, the first thermal conductor or the second thermal conductor suppresses uneven temperature of the heater 63B in the longitudinal direction X thereof efficiently. Additionally, the first thermal conductor or the second thermal conductor minimizes heat conducted to the heater holder 64A. The first thermal conductor or the second thermal conductor that is made of graphite attains enhanced heat resistance that inhibits oxidation at approximately 700 degrees Celsius.

The graphite sheet has a physical property and a dimension that are adjusted properly according to a function of the first thermal conductor or the second thermal conductor. For example, the graphite sheet is made of graphite having enhanced purity or single crystal graphite. The graphite sheet has an increased thickness to enhance anisotropic thermal conduction. In order to perform high speed fixing, the fixing devices 60F and 60G employ the graphite sheet having a decreased thickness to decrease thermal capacity of the fixing devices 60F and 60G. If the fixing nip N and the heater 63B have an increased width in the longitudinal X thereof, the first thermal conductor or the second thermal conductor also has an increased width in the longitudinal direction X thereof.

In view of increasing mechanical strength, the graphite sheet preferably has a number of layers that is not smaller than 11 layers. The graphite sheet may include a part constructed of a single layer and another part constructed of a plurality of layers.

The above describes the embodiments of the present disclosure applied to a fixing device (e.g., the fixing devices 20, 20A, 20B, 20C, 60, 60A, 60B, 60C, 60D, 60E, 60F, 60G, and 83) as one example of a belt type heating device including a rotator driver. However, application of the embodiments of the present disclosure is not limited to the fixing device. Alternatively, the embodiments of the present disclosure may be applied to a dryer that dries liquid such as ink applied on a sheet, a laminator that bonds film as a coating member onto a surface of a sheet by thermocompression, and a heating device such as a heat sealer that bonds sealing portions of a packaging material by thermocompression. The embodiments of the present disclosure are also applied to a rotator driver that does not incorporate a heat source such as a heater.

A description is provided of advantages of a rotator driver (e.g., the rotator driver 9).

As illustrated in FIGS. 2, 4, 5, 7, and 8, the rotator driver is rotated mainly in one direction and includes an endless rotator (e.g., the fixing belts 21, 61, and 61A and the belts 71 and 72), a slide aid (e.g., the nip formation pads 24, 68, and 74, the slide sheet 28, and the heaters 63, 63A, 63B, 63C, and 63D), an end face contact member (e.g., the caps 29A and 29B), a first helical gear (e.g., the first gear 41), and a second helical gear (e.g., the second gear 42). The endless rotator rotates. The slide aid contacts an inner circumferential face (e.g., the inner circumferential faces 21*c*, 61*c*, 61Ac, and 72*c*) of the endless rotator. A lubricant is applied between the slide aid and the inner circumferential face of the endless rotator. The end face contact member contacts an end face (e.g., the end face 21*a*) of the endless rotator in a longitudinal direction (e.g., the longitudinal direction X) of the endless rotator. The end face contact member has an end face opposed face (e.g., the end face opposed face 29A1) that contacts the end face of the endless rotator and an opposite face (e.g., the opposite face 29A2) that is opposite to the end face opposed face. The first helical gear is mounted on the opposite face of the end face contact member. The second helical gear meshes with the first helical gear. The first helical gear has teeth (e.g., the teeth 41*a*) of which helix angle is oriented to generate a force that moves the end face contact member toward the end face of the endless rotator as the first helical gear rotates in the one direction. The first helical gear has an outer diameter (e.g., the outer diameter D1) that is not greater than an outer diameter (e.g., the outer diameter D2) of the endless rotator.

Accordingly, the rotator driver prevents the lubricant from entering a gap between the end face of the endless rotator and the end face contact member.

According to the embodiments described above, each of the fixing belts 21, 61, 61A, and 71 serves as an endless rotator. Alternatively, a fixing film, a fixing sleeve, or the like may be used as an endless rotator. Further, each of the pressure rollers 22, 62, 69, 70, and 73 serves as an opposed rotator. Alternatively, a pressure belt or the like may be used as an opposed rotator.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

The invention claimed is:

1. A rotator driver, comprising:

an endless rotator to rotate, the endless rotator having an end face in a longitudinal direction of the endless rotator;

a slide aid contacting an inner circumferential face of the endless rotator, the slide aid and the endless rotator being applied with a lubricant between the slide aid and the inner circumferential face of the endless rotator;

an end face contactor having an end face opposed face to contact the end face of the endless rotator and an opposite face being opposite to the end face opposed face;

a first helical gear mounted on the opposite face of the end face contactor, the helical gear to rotate;

a second helical gear which meshes with the first helical gear, the first helical gear having teeth of which helix angle is oriented to generate a force that moves the end face contactor toward the end face of the endless rotator as the first helical gear rotates, the first helical gear having an outer diameter being not greater than an outer diameter of the endless rotator; and an opposed rotator to contact an outer circumferential face of the endless rotator to form a nip between the endless rotator and the opposed rotator, the opposed rotator including a shaft;

a driving force transmitting gear to transmit a driving force to the opposed rotator through the shaft of the opposed rotator;

wherein the endless rotator is driven by a rotation of the opposed rotator, and wherein the force that moves the end face contactor is due to the first gear driving the second gear.

2. The rotator driver according to claim 1, further comprising:

a rotation detector to detect rotation of a shaft connected to the second helical gear.

3. The rotator driver according to claim 2, further comprising:

a disk connected to the shaft connected to the second helical gear, wherein the rotation detector includes a photo interrupter which detects rotation of the disk.

4. The rotator driver according to claim 1, wherein the first helical gear includes a rotation shaft, and wherein the teeth of the first helical gear define an angle of inclination with respect to the rotation shaft of the first helical gear, the angle of inclination being not smaller than 1 degree and not greater than 30 degrees.

5. The rotator driver according to claim 1, wherein the lubricant includes oil.

6. The rotator driver according to claim 1, wherein the endless rotator includes a base layer including metal.

7. The rotator driver according to claim 1, further comprising:

an elastic layer sandwiched between the end face contactor and the outer circumferential face of the endless rotator.

8. The rotator driver according to claim 1, wherein the endless rotator includes an endless belt, wherein the slide aid includes at least one of a pad, a slide sheet, and a heater, and wherein the end face contactor includes a cap.

9. A heating device, comprising:

an endless rotator to rotate mainly in a forward direction, the endless rotator having an end face in a longitudinal direction of the endless rotator;

a slide aid contacting an inner circumferential face of the endless rotator, the slide aid and the endless rotator being applied with a lubricant between the slide aid and the inner circumferential face of the endless rotator;

an end face contactor having an end face opposed face to contact the end face of the endless rotator and an opposite face being opposite to the end face opposed face;

a helical gear mounted on the opposite face of the end face contactor, the helical gear to rotate, the helical gear having teeth of which helix angle is oriented to generate a force that moves the end face contactor toward the end face of the endless rotator as the helical gear rotates in the forward direction, the helical gear having an outer diameter being not greater than an outer diameter of the endless rotator;

an opposed rotator to contact an outer circumferential face of the endless rotator to form a nip between the endless rotator and the opposed rotator;

a driving force transmitting gear to transmit a driving force to the opposed rotator in both the forward direction and a backward direction; and a motor to drive the drive force transmitting gear in both the forward direction and the backward direction.

10. The heating device according to claim 9, further comprising:

another helical gear to mesh with the helical gear and rotate.

11. The heating device according to claim 10, further comprising:

a housing having a region defined by a center of the endless rotator in the longitudinal direction of the endless rotator, the region accommodating the driving force transmitting gear, the helical gear, and said another helical gear.

12. The heating device according to claim 9, wherein:

the slide aid is to heat the endless rotator.

13. The heating device according to claim 9, further comprising:

an electromagnetic induction heater to heat the endless rotator.

14. The heating device according to claim 9, further comprising:

a one-way clutch attached to the helical gear, the one-way clutch to transmit a torque that rotates the end face contactor to the helical gear, and that does not transmit the torque that rotates the end face contactor to the helical gear when the driving force transmitting gear is rotation in the backward direction.

15. The heating device according to claim 9, wherein:

the opposed rotator includes a roller.

16. A fixing device comprising the heating device according to claim 9.

17. The heating device according to claim 9, wherein:

a time of driving the opposed rotator in the backward direction is shorter than a time of rotating the opposed rotator in the forward direction while fixing an image on a sheet.

18. The heating device according to claim 9, wherein:

a speed of driving the opposed rotator in the backward direction is smaller than a speed of rotating the opposed rotator in the forward direction while fixing an image on a sheet.

19. An image forming apparatus comprising:

an image bearer to bear an image; and a fixing device to fix the image on a recording medium, the fixing device including:

an endless rotator to rotate mainly in a forward direction, the endless rotator having an end face in a longitudinal direction of the endless rotator;

a slide aid contacting an inner circumferential face of the endless rotator, the slide aid and the endless rotator being applied with a lubricant between the slide aid and the inner circumferential face of the endless rotator;

an end face contactor having an end face opposed face to contact the end face of the endless rotator and an opposite face being opposite to the end face opposed face;

a helical gear mounted on the opposite face of the end face contactor, the helical gear to rotate, the helical gear having teeth of which helix angle is oriented to generate a force that moves the end face contactor toward the end face of the endless rotator as the helical gear rotates in the forward direction, the helical gear having an outer diameter being not greater than an outer diameter of the endless rotator;

an opposed rotator to contact an outer circumferential face of the endless rotator to form a nip between the endless rotator and the opposed rotator;

a driving force transmitting gear to transmit a driving force to the opposed rotator in both the forward direction and a backward direction; and a motor to drive the drive force transmitting gear in both the forward direction and the backward direction.

* * * * *